United States Patent [19]

Uranishi et al.

[11] Patent Number: 4,841,940

[45] Date of Patent: Jun. 27, 1989

[54] AIR-FUEL RATIO CONTROL DEVICE OF AN INTERNAL COMBUSTION ENGINE

[75] Inventors: Kouji Uranishi, Susono; Takaaki Itou, Mishima, both of Japan

[73] Assignee: Toyota Jidosha Kabushiki Kaisha, Toyota, Japan

[21] Appl. No.: 178,373

[22] Filed: Apr. 6, 1988

[30] Foreign Application Priority Data

| | | | |
|---|---|---|---|
| Apr. 7, 1987 | [JP] | Japan | 62-083848 |
| Sep. 10, 1987 | [JP] | Japan | 62-225284 |
| Sep. 11, 1987 | [JP] | Japan | 62-226554 |

[51] Int. Cl.[4] ..... F02M 25/08; F02M 51/00

[52] U.S. Cl. ..... 123/520; 123/489; 123/416

[58] Field of Search ..... 123/489, 520, 416, 415, 123/408, 568

[56] References Cited

U.S. PATENT DOCUMENTS

| | | | |
|---|---|---|---|
| 3,680,318 | 8/1972 | Nakajima et al. | 123/519 X |
| 3,872,848 | 3/1975 | King | 123/520 |
| 4,748,959 | 6/1988 | Cook et al. | 123/489 |
| 4,771,752 | 9/1988 | Nishimura et al. | 123/489 |

*Primary Examiner*—Raymond A. Nelli

*Attorney, Agent, or Firm*—Cushman, Darby & Cushman

[57] ABSTRACT

An air-fuel ratio control device comprising an electric air bleed control valve which controls the amount of air fed into the fuel passage of the carburetor so that an air-fuel ratio becomes equal to the stoichiometric air-fuel ratio. The degree of opening of the air bleed control valve is increased as an electric current fed into the air bleed control valve is increased. Fuel vapor is fed into the intake passage from the canister. When the electric current fed into the air bleed control valve is increased and reaches a predetermined upper limit due to the supply of purge gas, the current fed into the air bleed control valve is instantaneously increased by a fixed amount.

23 Claims, 21 Drawing Sheets

AIR-FUEL RATIO CONTROL DEVICE OF AN INTERNAL COMBUSTION ENGINE

BACKGROUND OF THE INVENTION

1. Field of the Invention

The present invention relates to a air-fuel ratio control device of an internal combustion engine.

2. Description of the Related Art

An internal combustion engine is known, which comprises an electric purge control valve for controlling the supply of purge gas fed into the intake passage of an engine from a charcoal canister, and an electric air bleed control valve for controlling the amount of air fed into the fuel passage of a carburetor. An electric current fed into the air bleed control valve is controlled on the basis of the output signal of an oxygen concentration detecting sensor (hereinafter referred to as an $O_2$ sensor) arranged in the exhaust passage of the engine so that the amount of air fed into the fuel passage of the carburetor is increased as the amount of electric current fed into the air bleed control valve is increased (Japanese Unexamined Patent Publication No. 61-1857). In this engine, when the purge control valve is opened, and thus the supply of the purge gas is started, if the purge gas contains a large fuel component, an air-fuel mixture fed into the engine cylinders becomes extremely rich. As a result, the amount of electric current fed into the air bleed control valve is gradually increased so that an air-fuel ratio approaches the stoichiometric air-fuel ratio, and accordingly, the amount of air fed into the fuel passage of the carburetor is gradually increased. Subsequently, when the electric current fed into the air bleed control valve is increased to the maximum level of the controllable range, an air-fuel ratio control is changed from the air-fuel ratio control based on the air bleed control to the air-fuel ratio control based on the purge control, and thus the amount of purge gas is controlled so that the air-fuel ratio approaches the stoichiometric air-fuel ratio.

However, actually, when the supply of purge gas is started, the electric current fed into the air bleed control valve normally does not reach the maximum level of the controllable range, and thus, at this time, the amount of air fed into the fuel passage of the carburetor from the air bleed passage is gradually increased until the air-fuel ratio of air-fuel mixture fed into the engine cylinders becomes equal to the stoichiometric air-fuel ratio. However, if the amount of air fed from the air bleed passage is gradually increased as mentioned above, it takes a long time to equalize the air-fuel ratio with the stoichiometric air-fuel ratio. Consequently, since an extremely rich air-fuel mixture is still fed into the engine cylinders for a long time, a problem occurs in that a large amount of unburned HC and CO is discharged from the engine cylinders during that time.

A fuel injection type engine having a charcoal canister is also known. The charcoal canister comprises a fuel vapor outlet connected to the intake passage in the vicinity of the throttle valve, and an air inlet connected to the intake passage upstream of the throttle valve and downstream of the air flow meter (Japanese unexamined Utility Model publication No. 61-13735). In this engine, when the throttle valve is open, the fuel vapor outlet of the charcoal canister is connected to the intake passage downstream of the throttle valve. Consequently, at this time, a part of air metered by the air flow meter is fed into the charcoal canister, and thus the fuel component adsorbed in the activated carbons is desorbed by this air. The fuel component thus desorbed is then fed into the intake passage.

In addition, another fuel injection type engine having a charcoal canister is known, wherein the charcoal canister comprises a fuel vapor outlet connected to the intake passage in the vicinity of the throttle valve, and an air inlet selectively connected to the outside air or the intake passage upstream of the throttle valve and downstream of the air flow meter via a control valve (Japanese unexamined Utility Model publication No. 58-64854). In this engine, when the engine is stopped, the air inlet of the charcoal canister is connected to the outside air so that an excess fuel component which can not be adsorbed by the activated carbons can be discharged to the outside air but not to the intake passage, when a large amount of fuel vapor is generated in the fuel tank. Conversely, when the engine is operating, the air inlet of the charcoal canister is connected to the intake passage between the throttle valve and the air flow meter. Consequently, when the throttle valve is open, a part of air metered by the air flow meter is fed into the charcoal canister, and the fuel component desorbed from the activated carbons is fed into the intake passage.

Note, in the above-mentioned fuel injection type engines, the injection time TAU of the fuel injector is determined basically on the following equation.

$$TAU = TP \cdot FAF$$

In this equation, TP indicates a basic injection time determined by both the engine speed and the amount of air fed into the engine cylinders, and FAF indicates a feedback correction coefficient changed on the basis of the output signal of the $O_2$ sensor so that an air-fuel ratio becomes equal to the stoichiometric air-fuel ratio. This FAF normally varies around 1.0 and, to prevent the FAF from becoming excessively large or excessively small, an upper guard and a lower guard are provided for the FAF. The upper guard is, for example, 1.2, and the lower guard is, for example, 0.8. When the FAF is increased and reaches the upper guard, that is, 1.2, the FAF is maintained at 1.2, and when the FAF is reduced and reaches the lower guard, that is, 0.8, the FAF is maintained at 0.8. Therefore, the FAF is able to vary between 0.8 and 1.2.

In the above-mentioned fuel injection type engines, when the supply of purge gas from the charcoal canister into the intake is started, if the purge gas contains a large fuel component, an air-fuel mixture fed into the engine cylinders becomes extremely rich. At this time, the FAF is reduced to the amount of fuel injected from the fuel injection. However, at this time, the FAF sometimes reaches the lower guard and is maintained at 0.8. In this case, the feedback operation of the air-fuel ratio is no longer carried out, and the air-fuel mixture remains rich, and as a result, a problem occurs in that a large amount of unburned HC and CO is discharged from the engine cylinders.

SUMMARY OF THE INVENTION

An object of the present invention is to provide an air-fuel ratio control device capable of reducing the amount of unburned HC and CO discharged from the engine cylinders by making an air-fuel ratio equal to the stoichiometric air-fuel ratio after the supply of purge gas is started.

According to the present invention, there is provided an internal combustion engine having at least one cylinder, an intake passage and an exhaust passage, said engine comprising: a charcoal canister containing activated carbon therein and connected to the intake passage via a purge passage; fuel supply means arranged in the intake passage to feed fuel into the intake passage; an oxygen concentration detector arranged in the exhaust passage to produce a lean signal when an air-fuel ratio of an air-fuel mixture fed into the cylinder is larger than a predetermined air-fuel ratio and to produce a rich signal when the air-fuel ratio of the air-fuel mixture is smaller than the predetermined air-fuel ratio; first means producing an electrical correction signal for correcting the amount of fuel fed from the fuel supply means in response to the lean signal and the rich signal to equalize the air-fuel ratio of air-fuel mixture with the predetermined air-fuel ratio; the electric correction signal having a level which normally varies between a predetermined upper limit and a predetermined lower limit and reaches either one of the predetermined upper limit and the predetermined lower limit when the air-fuel mixture fed into the cylinder becomes excessively rich; determining means for determining whether or not the level of the electric correction signal reaches either one of the predetermined upper limit and the predetermined lower limit; and second control means operated on the basis of a determination of the determining means to increase the air-fuel ratio of the air-fuel mixture fed into the cylinder until this ratio becomes approximately equal to the predetermined air-fuel ratio when the level of the electric correction signal reaches either one of the predetermined upper limit and the predetermined lower limit.

The present invention may be more fully understood from the description of preferred embodiments of the invention set forth below, together with the accompanying drawings.

BRIEF DESCRIPTION OF THE DRAWINGS

In the drawings:

FIGS. 9, 9A & 9B are a flow chart for executing the calculation of the feedback correction coefficient;

DESCRIPTION OF THE PREFERRED EMBODIMENTS

Figure 1:
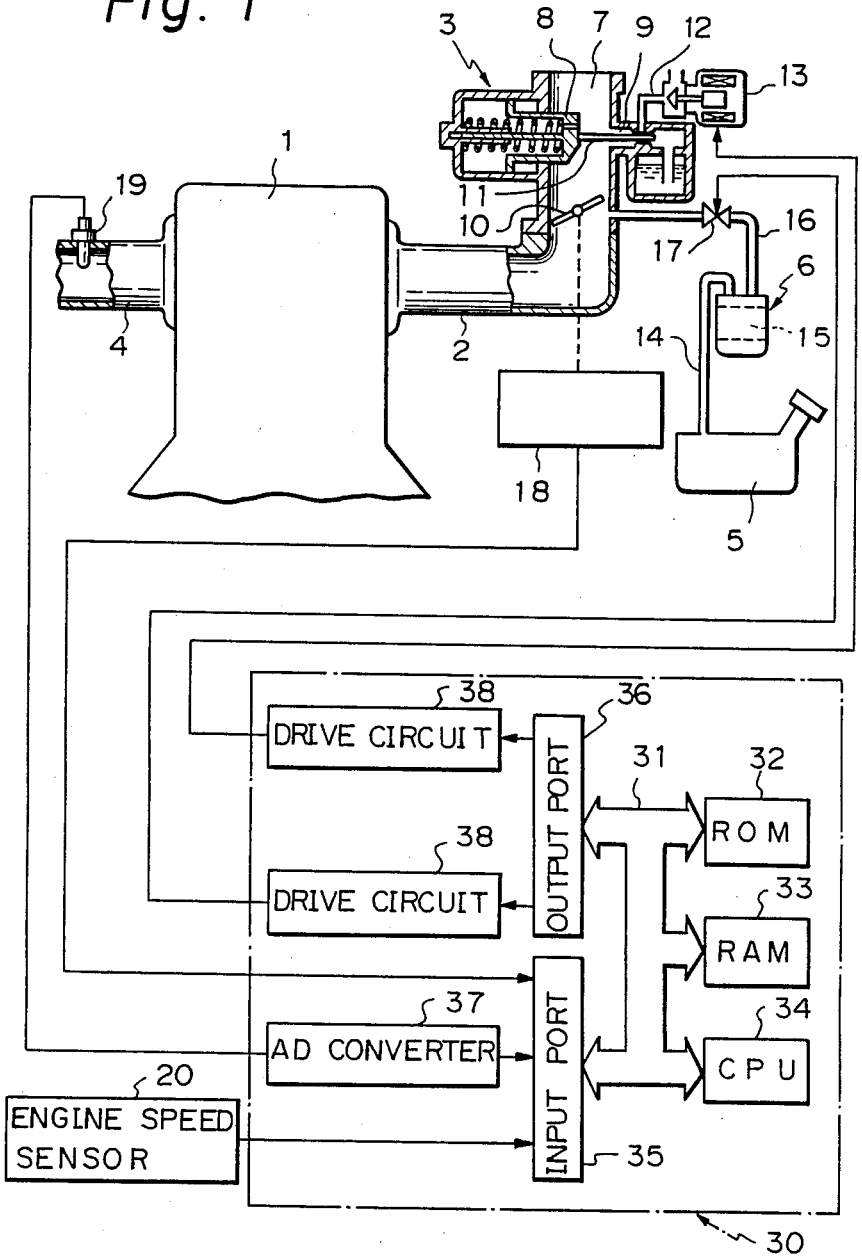
FIG. 1 is a schematically illustrated view of an engine.

Referring to FIG. 1, reference numeral 1 designates an engine body, 2 an intake manifold, 3 a variable venturi type carburetor, and 4 an exhaust manifold; 5 designates a fuel tank, and 6 a charcoal canister containing activated carbon. The variable venturi type carburetor 3 comprises an intake passage 7, a suction piston 8, a fuel passage 9 which is open to the intake passage 7, and a throttle valve 10. The amount of fuel fed into the intake passage 7 from the fuel passage 9 is controlled by a needle 11 mounted on the suction piston 8. An air bleed passage 12 is connected to the fuel passage 9, and an air bleed control valve 13 is arranged in the air bleed passage 12. This air bleed control valve 13 is controlled on the basis of control current output from an electronic control unit 30. When the control current fed into the air bleed control valve 13 is increased, the amount of air fed into the fuel passage 9 from the air bleed passage 12 is increased, and thus the air-fuel mixture fed into the engine cylinders becomes lean. Conversely, when the control current fed into the air bleed control valve 13 is reduced, the amount of air fed into the fuel passage 9 from the air bleed passage 12 is reduced, and thus the air-fuel mixture fed into the engine cylinders becomes rich.

The fuel tank 5 is connected to the charcoal canister 6 via a fuel vapor conduit 14, and fuel vapor produced in the fuel tank 5 is adsorbed by the activated carbon 15 in the canister 6. In addition, the canister 6 is connected via a purge conduit 16 to the intake passage 7 downstream of the throttle valve 10, and a purge control valve 17 is arranged in the purge conduit 16. When the purge control valve 17 is opened, fuel adsorbed in the activated carbon 15 is desorbed therefrom, and thus fuel vapor is fed into the intake passage 7 from the purge conduit 16.

The electronic control unit 30 is constructed as a digital computer and comprises a ROM (read only memory) 32, a RAM (random access memory) 33, a CPU (microprocessor, etc.) 34, an input port 35, and an output port 36. The ROM 32, the RAM 33, the CPU 34, the input port 35, and the output port 36 are interconnected via a bidirectional bus 31. A throttle switch 18 detecting an idling opening degree of the throttle valve 10 is attached to the throttle valve 10, and the output signal of the throttle switch 18 is input to the input port 35. An $O_2$ sensor 19 is arranged in the exhaust manifold 4, and the output signal of the $O_2$ sensor 19 is input to the input port 35 via an AD converter 37. In addition, an engine speed sensor 20 producing output pulses having a frequency proportional to the engine speed is connected to the input port 35. The output port 36 is connected to the air bleed control valve 13 and the purge control valve 17 via corresponding drive circuits 38.

An air-fuel ratio control according to the present invention will be hereinafter described with reference to FIGS. 2 through 6.

Figure 5:
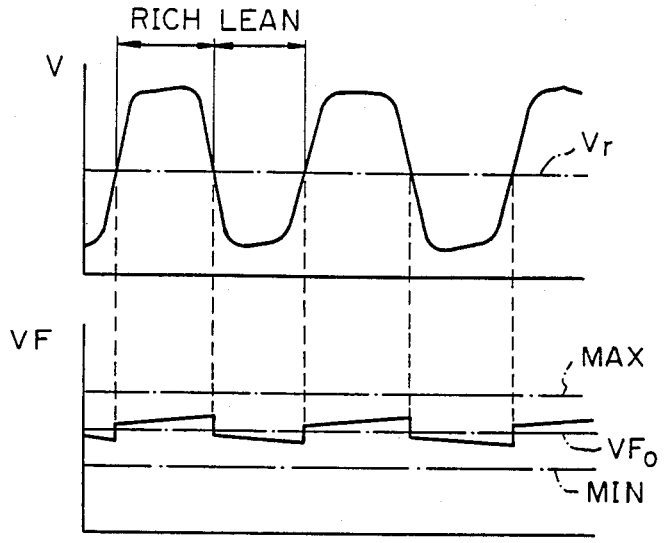
FIG. 5 is a diagram illustrating the output signal of the $O_2$ sensor and the control electric current VF.

FIG. 5 illustrates changes in the output voltage V of the $O_2$ sensor 19. The $O_2$ sensor 19 produces the output voltage V of about 0.9 volt when the air-fuel mixture is rich, and produces the output voltage V of about 0.1 volt when the air-fuel mixture is lean. The output voltage V of the $O_2$ sensor 19 is compared with a reference voltage Vr of about 0.45 volt in the CPU 34. At this time, if the output voltage V of the $O_2$ sensor 19 is higher than Vr, the air-fuel mixture is considered rich, and if the output voltage V of the $O_2$ sensor 19 is lower than Vr, the air-fuel mixture is considered lean.

Figure 2:
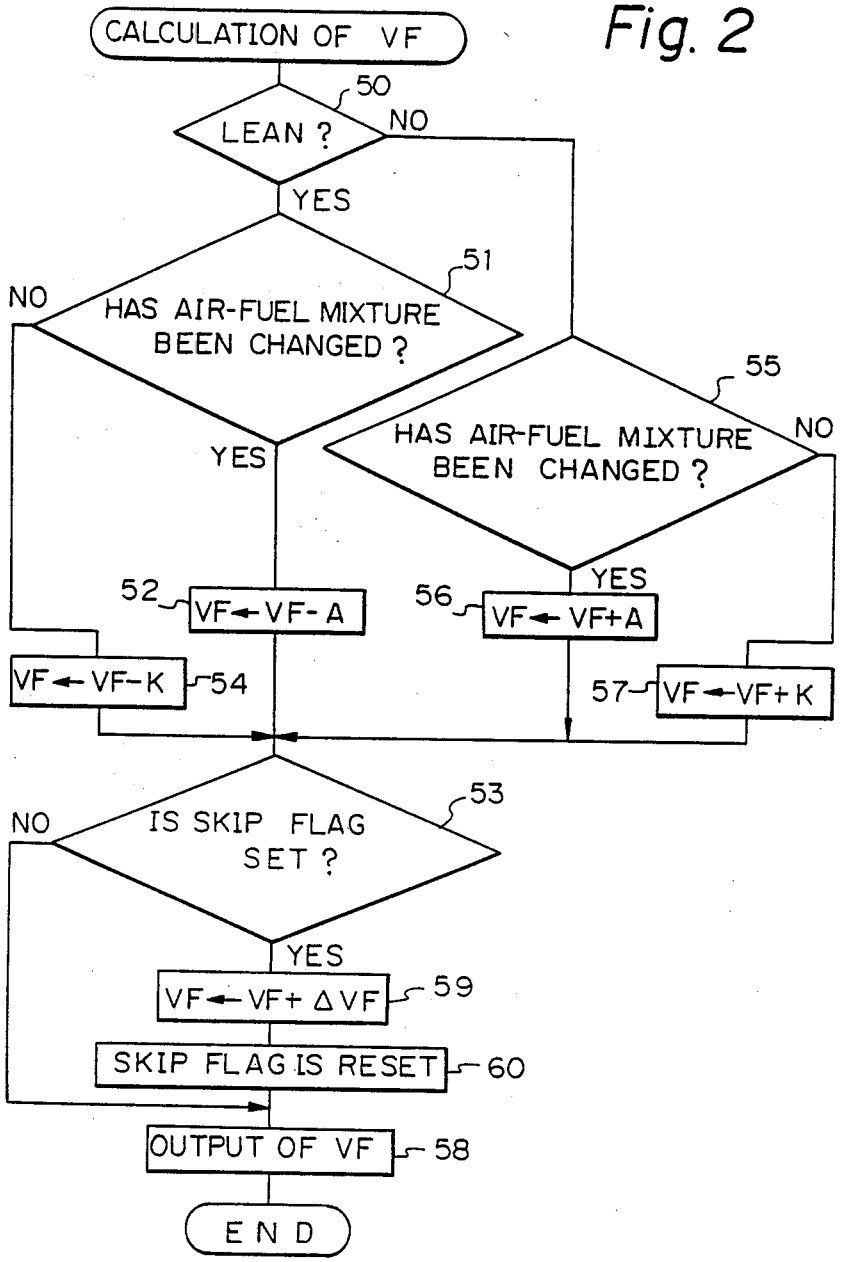
FIG. 2 is a flow chart for executing the calculation of the control electric current VF.

FIG. 2 illustrates a routine for the calculation of the control current VF of the air bleed control valve 13, which calculation is carried out on the basis of a determination of whether the air-fuel mixture is rich or lean.

Referring to FIG. 2, in step 50, it is determined whether or not the air-fuel mixture is lean. When the air-fuel mixture is lean, the routine goes to step 51, and it is determined whether the air-fuel mixture has been changed from rich to lean after completion of the preceding processing cycle. When the air-fuel mixture has been changed from rich to lean, the routine goes to step 52, and a skip value A is subtracted from VF. Then, the routine goes to step 53. When the air-fuel mixture has not been changed from rich to lean after completion of the preceding processing cycle, the routine goes to step 54, and an integration value $K(K<<A)$ is subtracted from VF. Then, the routine goes to step 53.

When it is determined in step 50 that the air-fuel mixture is rich, the routine goes to step 55, and it is determined whether the air-fuel mixture has been changed from lean to rich after completion of the preceding processing cycle. When the air-fuel mixture has been changed from lean to rich, the routine goes to step 56, and the skip value A is added to VF. Then, the routine goes to step 53. When the air-fuel mixture has not been changed from lean to rich after completion of the preceding processing cycle, the routine goes to step 57, and the integration value K is added to VF. Then, the routine goes to step 53. In step 53, it is determined whether a skip flag indicating that VF is to be instantaneously increased by a fixed value is set. Since this skip flag is normally reset, the routine jumps to step 58, and VF is output to the output port 36.

Consequently, as illustrated in FIG. 5, when the air-fuel mixture is changed from rich to lean, the value of VF is abruptly reduced by the skip value A and then gradually reduced. Conversely, when the air-fuel mixture is changed from lean to rich, the value of VF is abruptly increased and then gradually increased. The value of VF calculated in each step 52, 54, 56, 57 and output to the output port 36 in step 58 in FIG. 2 represents a duty cycle of pulse, and the serial pulses which are produced at a fixed frequency and have a pulse width changed in accordance with the duty cycle are fed into the air bleed control valve 13. The opening degree of the air bleed control valve 13 is controlled in response to the mean value of the current of the serial pulses and, therefore, VF is called the control current of the air bleed control valve 13. As illustrated in FIG. 5, this control current VF normally moves up and down around a reference value $VF_0$ when the feedback control of air-fuel ratio is carried out. Consequently, where the value of VF, which is slightly larger than the reference value $VF_0$, is defined by an upper limit value MAX, and the value of VF, which is slightly smaller than the reference value $VF_0$, is defined by a lower limit value MIN, the control current VF normally moves up and down between MAX and MIN when the feedback control of air-fuel ratio is carried out. In other words, if the control current VF is between MAX and MIN, the normal feedback control of air-fuel ratio is carried out.

Turning to FIG. 2, when it is determined in step 53 that the skip flag is set, the routine goes to step 59, and a fixed value $\Delta VF$ is added to VF. This fixed value $\Delta VF$ is considerably larger than the skip value A. Then, in step 60, the skip flag is reset.

Figure 6:
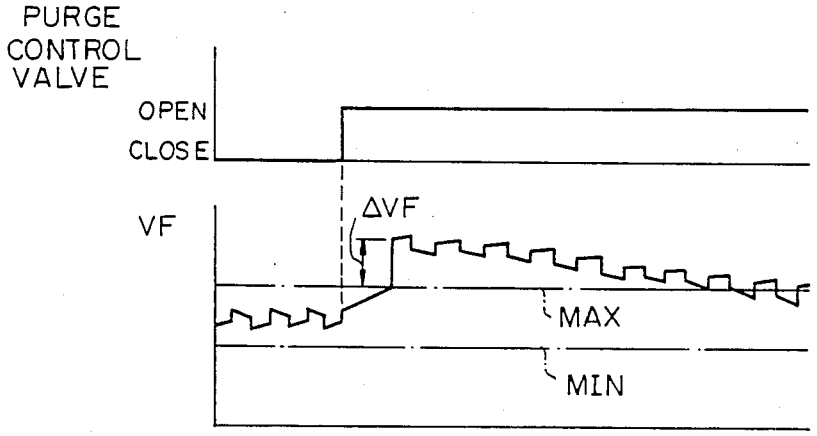
FIG. 6 is a diagram illustrating the control electric current VF and the opening operation of the purge control valve.

FIG. 6 illustrates the opening of the purge control valve 17 and changes in the value of VF. As illustrated in FIG. 6, when the purge control valve 17 is closed, and thus the supply of purge gas to the intake passage 2 is stopped, the control current VF moves up and down between MIN and MAX. Then, if the purge control valve 17 is opened, and thus the purge gas containing a large fuel component is fed into the intake passage 2, since the air-fuel mixture fed into the engine cylinders becomes excessively rich, the control electric current VF is increased and reaches the upper limit value MAX as illustrated in FIG. 6. When the control current VF reaches the upper limit value MAX, the control current VF is instantaneously increased by the fixed value $\Delta VF$ as illustrated in FIG. 6. The fixed value $\Delta VF$ is previously determined so that the control current VF is instantaneously increased to a control current VF necessary to equalize an air-fuel ratio with the stoichiometric air-fuel ratio. Note, this fixed value $\Delta VF$ is obtained by experiment. Consequently, when the control current VF is instantaneously increased by the fixed value $\Delta VF$, the air-fuel ratio becomes approximately equal to the stoichiometric air-fuel ratio and, after that, the control current VF is controlled so that the air-fuel ratio becomes equal to the stoichiometric air-fuel ratio. After the supply of purge gas is started, since the percentage of fuel vapor in the purge gas is gradually reduced, the control current VF is accordingly gradually reduced. As mentioned above, in this embodiment, if the control current VF reaches the upper limit value MAX after the supply of purge gas is started, the air-fuel ratio is instantaneously made approximately equal to the stoichiometric air-fuel ratio, which makes it possible to shorten the length of time during which the air-fuel mixture is in an extremely rich state, and thus it becomes possible to reduce the amount of unburned HC and CO discharged from the engine cylinders.

Figure 3:
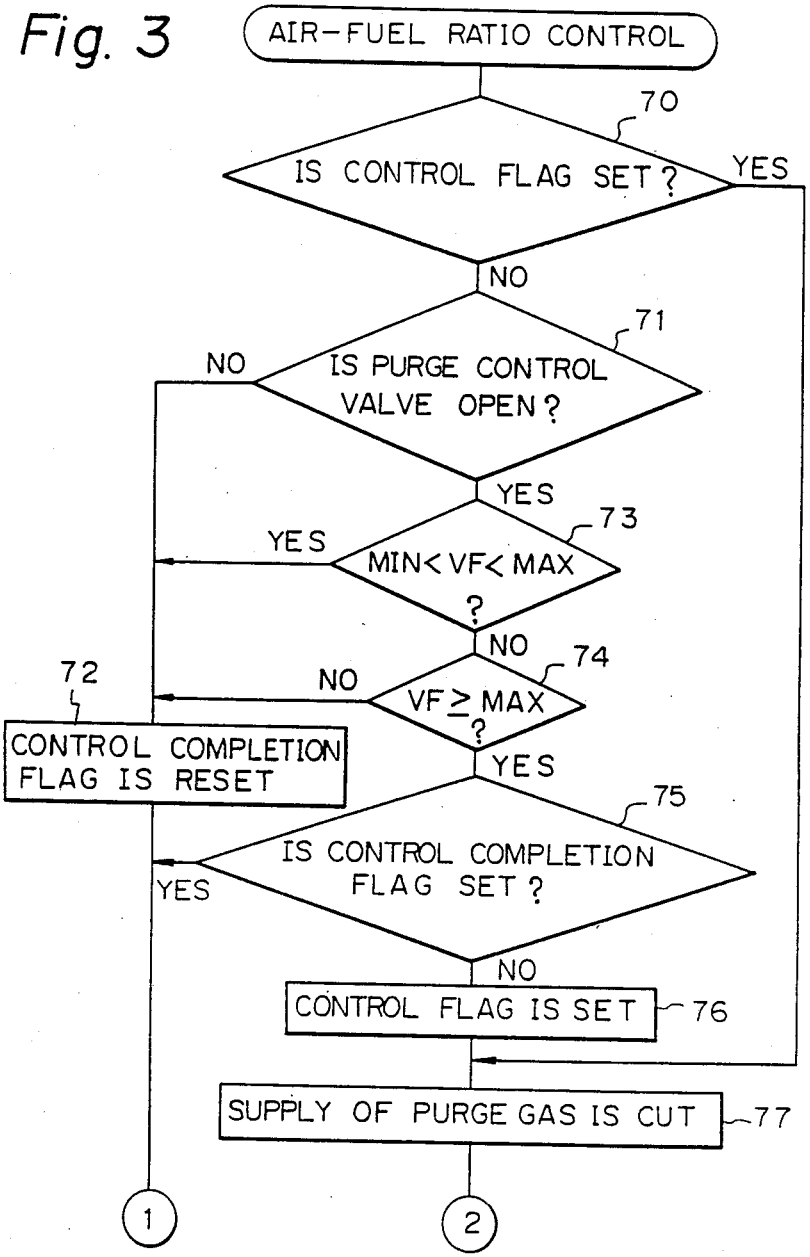
FIGS. 3 and 4 are a flow chart for executing the control of an air-fuel ratio.
Figure 4:
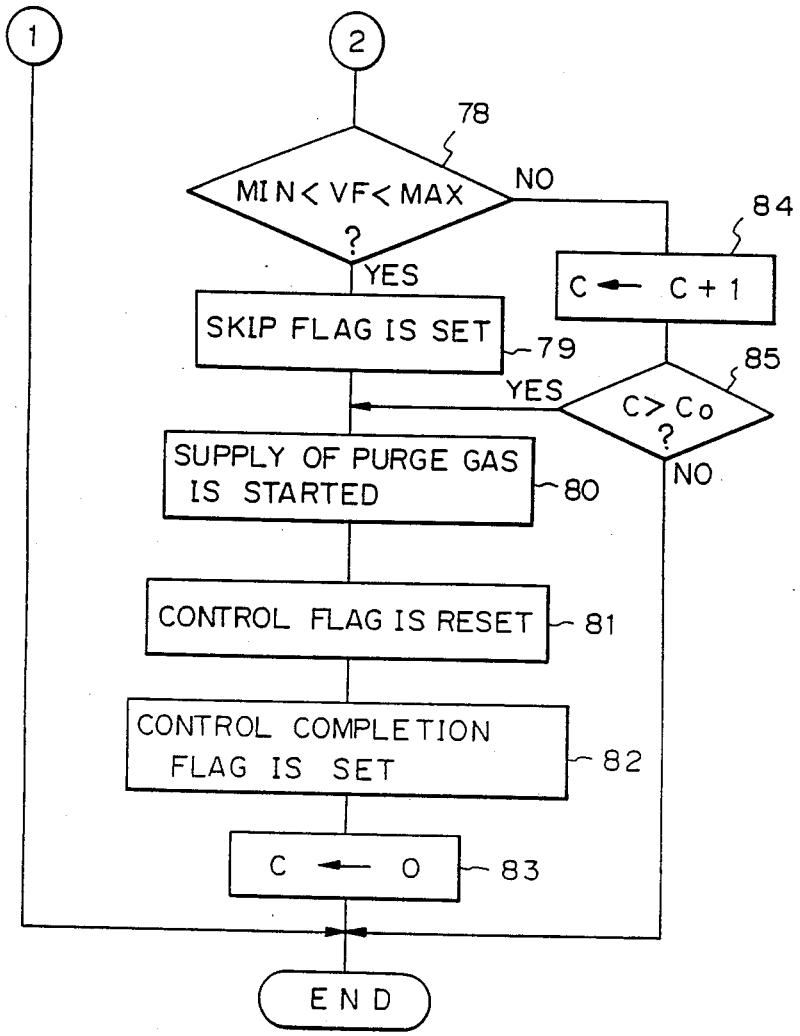

FIGS. 3 and 4 illustrate a flow chart for executing the air-fuel ratio control illustrated in FIG. 6. The routine illustrated in FIG. 3 is processed by sequential interruptions which are executed at predetermined intervals.

Referring to FIGS. 3 and 4, in step 10, it is determined whether or not a control flag is set. Since this control flag is normally reset, the routine goes to step 71, and it is determined whether or not the purge control valve 17 is open. This purge control valve 17 is closed, for example, when the engine is operating in an idling state, and the purge control valve 17 is open when the throttle valve 10 is open. When the purge control valve 17 is closed, the routine goes to step 72, and a control completion flag is reset. Conversely, when the purge control valve 17 is open, the routine goes to step 73, and it is determined whether or not the control electric current VF is between MIN and MAX. Even if the purge control valve 17 is open, when the control electric current VF is between MIN and MAX, the processing cycle is completed after the routine goes to step 72. Conversely, when the purge control valve 17 is open, if the control electric current VF becomes lower than MIN or higher than MAX, the routine goes to step 74, and it is determined whether or not the control current VF is equal to or larger than MAX. If $VF<MAX$, the processing cycle is completed after the routine goes to step 72. If $VF \geqq MAX$, the routine goes to step 75, and it is determined whether or not the control completion flag is set. When the control current VF reaches MAX after the supply of purge gas is started, since the control completion flag is reset, the routine goes to step 76, and the control flag is set. Then, in step 77, the purge control valve 17 is closed, and thus the supply of purge gas is stopped.

Then, in step 78, it is determined whether or not the control current VF is between MIN and MAX. That is, it is determined whether or not the control current VF has returned to a value between MIN and MAX after the supply of purge gas is stopped. If the control current VF has returned to a value between MIN and MAX, it is determined that the control current VF has become larger than MAX due to the supply of purge gas. That is, it can be considered that the air-fuel mixture has become excessively rich due to the supply of purge gas. Consequently, in this case, the routine goes to step 79, and the skip flag is set. As mentioned above with reference to FIG. 2, if the skip flag is set, the control current VF is instantaneously increased by the fixed value $\Delta VF$.

Then, in step 80, the purge control valve 17 is opened, and thus the supply of purge gas is started. Then, in step 81, the control flag is reset, and in step 82, the control completion flag is set. Then, in step 83, the counter is cleared, and the processing cycle is completed. In the next processing cycle, since the control flag is reset, the routine goes to step 74 via steps 71 and 73. Since it is determined in step 74 that the control current VF is larger than MAX, the routine goes to step 75. At this time, since the completion flag is set, the processing cycle is completed.

Conversely, when it is determined in step 78 that the control current VF is not between MIN and MAX, that is, when the control current VF is equal to or larger than MAX even if the supply of purge gas is stopped, the routine goes to step 84, and the count value C is incremented by 1. Then, in step 85, it is determined whether or not the count value C becomes larger than a fixed value $C_0$, that is, it is determined whether or not a fixed time has elapsed after the supply of purge gas is stopped. If $C \leqq C_0$, the processing cycle is completed. Conversely, if $C>C_0$, that is, if the state of $VF \geqq MAX$ continues for more than a fixed time after the supply of purge gas is stopped, it is determined that the air-fuel mixture is in an excessive rich state for a reason other than the supply of purge gas. Consequently, at this time, the routine goes to step 80 from step 85, and the supply of purge gas is started. Therefore, in this case, the skip flag is not set, and thus the control current VF is not increased by the fixed value $\Delta VF$. That is, when the control current VF exceeds MAX for a reason other than the supply of purge gas, the feedback control of the control current VF is continued without an instantaneous increase of the control current VF by the fixed value $\Delta VF$ to prevent the air-fuel mixture from becoming further excessively lean.

In this embodiment, when the supply of purge gas is started, and the air-fuel mixture becomes excessively rich, since the air-fuel ratio of air-fuel mixture is brought close to the stoichiometric air-fuel ratio within a short time, it is possible to reduce the amount of unburned HC and CO discharged from the engine cylinders.

Figure 7:
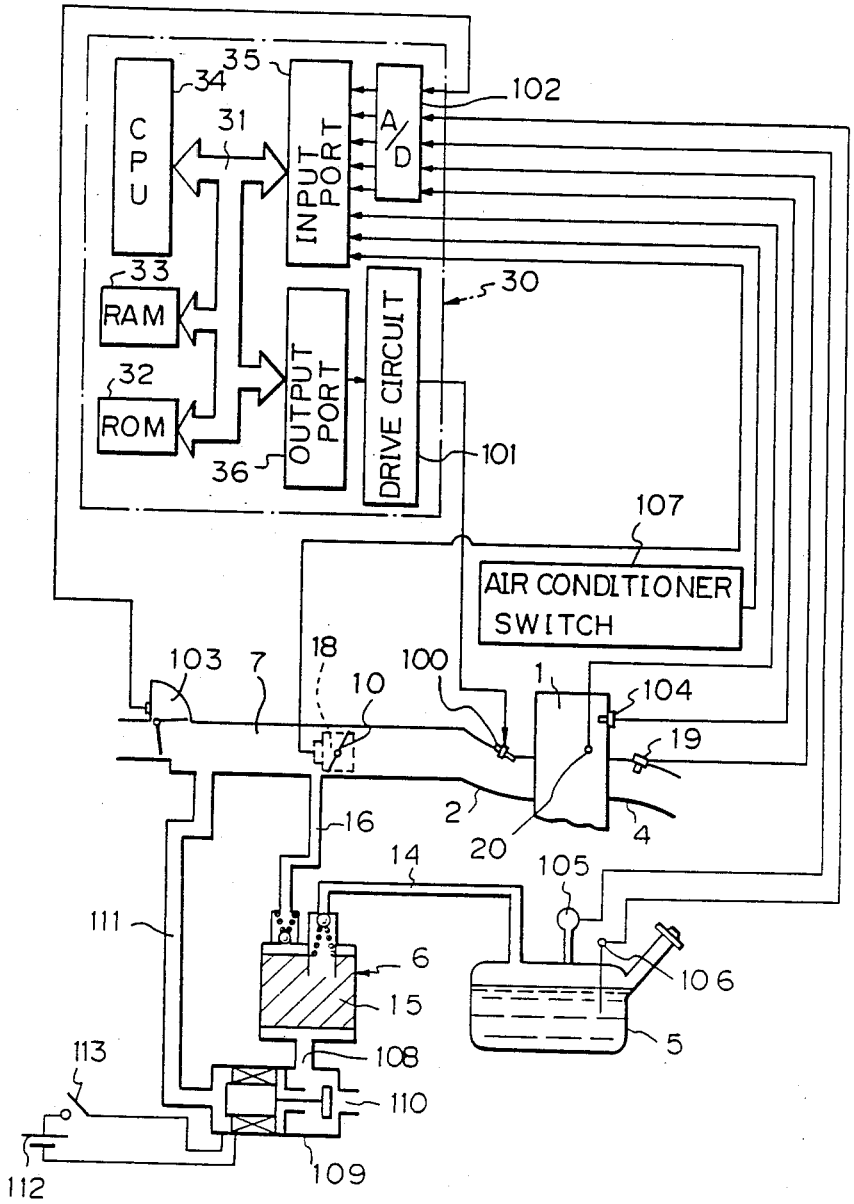
FIG. 7 is a schematically illustrated view of a fuel injection type engine.

FIG. 7 illustrates the case where the present invention is applied to a fuel injection type engine. In FIG. 7, similar components are indicated with the same reference numerals used in FIG. 1.

Referring to FIG. 7, in this engine, a fuel injector 100 is arranged in the intake manifold 2 and connected to the output port 36 of the electronic control unit 30 via a drive circuit 101. The electronic control unit 30 comprises an AD converter 102 having a multiplexing function, and the $O_2$ sensor 19 arranged in the exhaust manifold 4 is connected to the AD converter 102. An air flow meter 103 is arranged in the intake passage 7 upstream of the throttle valve 10 and connected to the AD converter 102. A cooling water temperature sensor 104 detecting the temperature of cooling water is attached to the engine body 1 and connected to the AD converter 102. A pressure sensor 105 for detecting pressure in the fuel tank 5 is arranged in the fuel tank 5, and a fuel temperature sensor 106 for detecting the temperature of fuel in the fuel tank 5 is also arranged in the fuel tank 5. Both the pressure sensor 105 and the fuel temperature sensor 06 are connected to the AD converter 102. In addition, the throttle switch 18 and the engine speed sensor 20 are connected to the input port 35. Furthermore, an air conditioner switch 107 is connected to the input port 35.

The charcoal canister 6 is connected to the fuel tank 5 via the fuel vapor conduit 14 and connected via the purge conduit 16 to the intake passage 7 in the vicinity of the throttle valve 10. This purge conduit 16 is open to the intake passage 7 upstream of the throttle valve 10 when the throttle valve 10 is in the idling position, and the purge conduit 16 is open to the intake passage 7 downstream of the throttle valve 10 when the throttle valve 10 is open. The charcoal canister 6 has an air inlet 108, and a control valve 109 attached to the air inlet 108. The air inlet 108 is selectively connected, by the control valve 109, to an outside air port 110 or an air conduit 111 which is connected to the intake passage 7 between the throttle valve 10 and the air flow meter 103. The solenoid of the control valve 109 is connected to a power source 112 via an ignition switch 113.

When the ignition switch 113 is OFF, the air inlet 108 is open to the outside air via the outside air port 110, and the air conduit 111 is shut off by the control valve 109. At this time, if a large amount of fuel vapor is generated in the fuel tank 5, and the amount of fuel vapor fed into the canister 6 exceeds the adsorption capacity of the activated carbon 15, fuel vapor which can not be adsorbed by the activated carbon 15 is discharged into the outside air via the outside air port 110. At this time, fuel vapor is not fed into the intake passage 7 via the purge conduit 16 and the air conduit 111.

When the ignition switch 113 is made ON, the air inlet 108 is connected to the air conduit 111, and the outside air port 110 is shut off by the control valve 109. When the throttle valve 10 is opened, and the purge 16 is open to the intake passage 7 downstream of the throttle valve 10, a part of air metered by the air flow meter 103 is fed into the charcoal canister 6 via the air conduit 111, and the fuel component adsorbed in the activated carbon 15 is fed into the intake passage 7 via the purge conduit 16. In the embodiment illustrated in FIG. 7, since the amount of air fed into the engine cylinders can be accurately metered by the air flow meter 103, it is possible to accurately equalize an air-fuel ratio with a predetermined air-fuel ratio on the basis of the output signal of the air flow meter 103.

In the embodiment illustrated in FIG. 7, the actual injection time TAU of the fuel injector 100 is calculated from the following equation.

$$TAU = TP \cdot (FAF + KG)\,(FWL + 1 + \alpha) + \beta$$

Where TP: a basic injection time
FAF a feedback correction coefficient
KG: a learning value
FWL: a temperature correction value
$\alpha$, $\beta$: other correction coefficients In this equation, the basic injection time is calculated from the engine speed and the amount of air fed into the engine cylinders. The feedback correction coefficient FAF is controlled based on the output signal of the $O_2$ sensor 19 so that an air-fuel ratio becomes equal to the stoichiometric air-fuel ratio. When the feedback operation of air-fuel ratio is carried out, both FWL and $\alpha$ become zero. At this time, the FAF normally moves up and down around 1.0.

The learning value KG is determined by learning the preceding movement of the FAF so that the FAF moves up and down around 1.0.

The temperature correction value FWL is provided for increasing the amount of fuel fed from the fuel injector 100 before the warm-up of the engine is completed.

In the above-mentioned equation, the functions of FAF and KG are important, and thus will be hereinafter described with reference to FIGS. 8 through 10.

Figure 8:
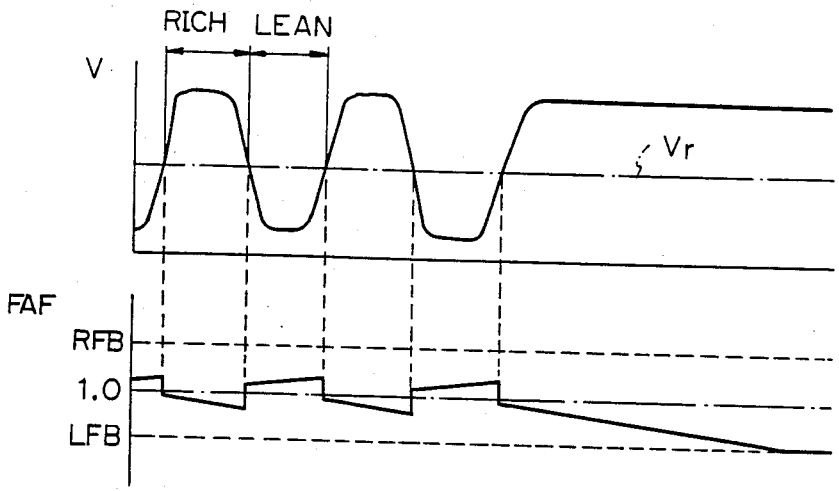
FIG. 8 is a diagram illustrating the output signal of the $O_2$ sensor and the feedback correction coefficient FAF.

FIG. 8 illustrates changes in the output voltage V of the $O_2$ sensor 19 and changes in the feedback correction coefficient FAF. As mentioned above, the $O_2$ sensor 19 produces an output voltage V of about 0.9 volt when the air-fuel mixture is rich, and produces an output voltage V of about 0.1 volt when the air-fuel mixture is lean. The output voltage V of the $O_2$ sensor 19 is compared with a reference voltage Vr of about 0.45 volt, by the CPU 34. At this time, if the output voltage V of the $O_2$ sensor 19 is higher than Vr, the air-fuel mixture is considered rich, and if the output voltage V of the $O_2$ sensor 19 is lower than Vr, the air-fuel mixture is considered lean.

Figure 9A:
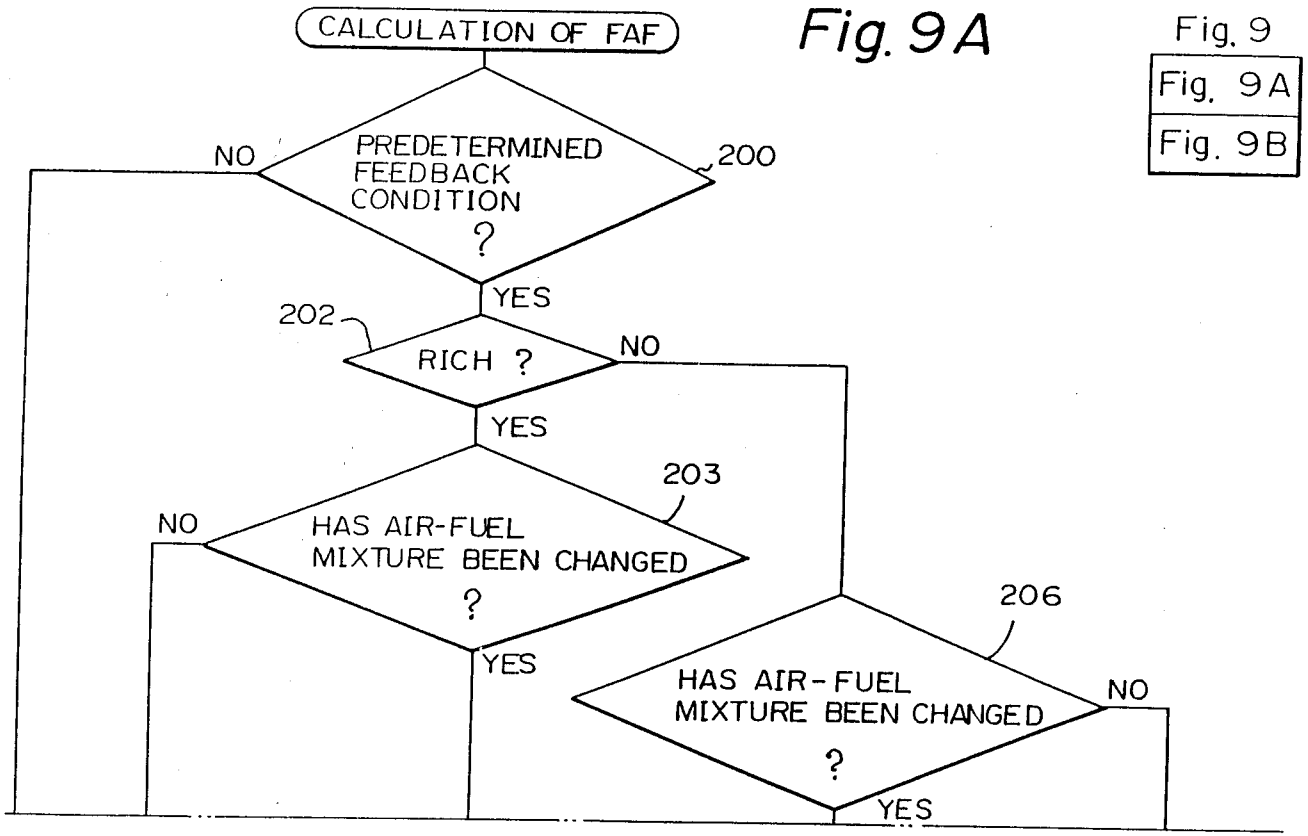
Figure 9B:
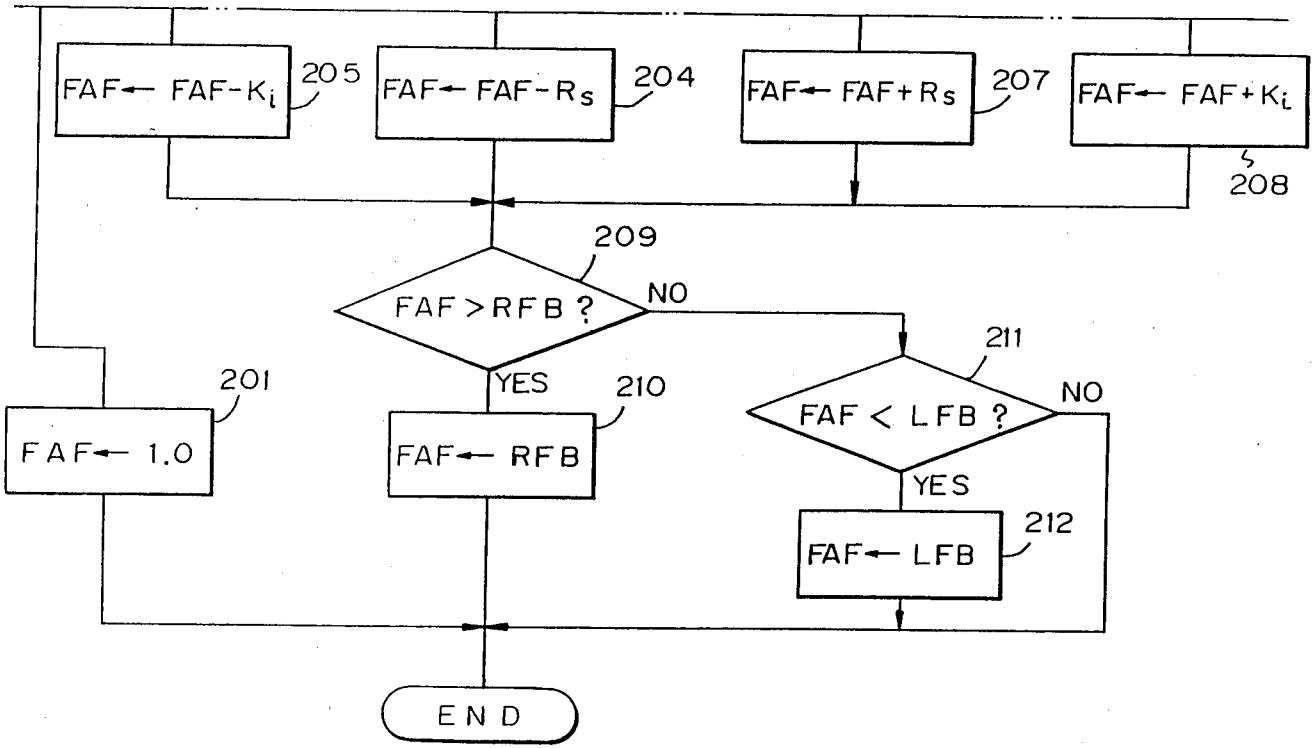

FIG. 9 illustrates a routine for the calculation of the feedback correction coefficient FAF, which calculation is carried out on the basis of a determination of whether the air-fuel mixture is rich or lean. The routine illustrated in FIG. 9 is processed by sequential interruptions which are executed at a predetermined interval, for example, every 4 msec.

Referring to FIG. 9, in step 200, it is determined whether the engine operating states, etc., satisfy a predetermined feedback condition. It is considered that the engine operating state, etc., does not satisfy the feedback condition, when, for example, the engine is started; the amount of fuel injected from the fuel injector 100 is increased beyond a normal amount after or before completion of the warm-up of the engine; the air-fuel ratio is controlled to a lean state; or the $O_2$ sensor 19 is in a inoperable state, etc. When the engine operating state, etc., does not satisfy the feedback condition, the routine goes to step 201, and the FAF becomes 1.0. At this time, the mean value of the FAF at the time immediately before the feedback control is stopped may be memorized as the FAF.

Conversely, when the engine operating state, etc., satisfies the feedback condition, the routine goes to step 202, and it is determined whether or not the air-fuel mixture is rich. When the air-fuel mixture is rich, the routine goes to step 203, and it is determined whether or not the air-fuel mixture has been changed from lean to rich after completion of the preceding processing cycle. When the air-fuel mixture has been changed from lean to rich, the routine goes to step 204, and a skip value Rs is subtracted from FAF. Then, the routine goes to step 209. When the air-fuel mixture has not been changed from lean to rich after completion of the preceding processing cycle, the routine goes to step 205, and an integration value K; ($K << Rs$) is subtracted from FAF. Then, the routine goes to step 209.

When it is determined in step 202 that the air-fuel mixture is lean, the routine goes to step 206, and it is determined whether or not the air-fuel mixture has been changed from rich to lean after completion of the preceding processing cycle. When the air-fuel mixture has been changed from rich to lean, the routine goes to step 207, and the skip value Rs is added to the FAF. Then the routine goes to step 109. When the air-fuel mixture has not been changed from rich to lean after completion of the preceding processing cycle, the routine goes to step 208, and the integration value K; is added to FAF. Then the routine goes to step 209.

In step 209, it is determined whether or not the FAF is larger than an upper guard value RFB, for example, 1.2. If $FAF > RFB$, the routine goes to step 210, and the upper guard value RFB is memorized as the FAF. Consequently, the FAF is maintained at the upper guard value RFB. Conversely, if $FAF \leqq RFB$, the routine goes to step 211, and it is determined whether or not the FAF is smaller than a lower guard value LFB, for example, 0.8. If $FAF < LFB$, the routine goes to step 212, and the lower guard value LFB is memorized as the FAF. Consequently, the FAF is maintained the lower guard value LFB.

Therefore, as illustrated in FIG. 8, when the air-fuel mixture is changed from lean to rich, the value of the FAF is abruptly reduced by the skip value Rs and then gradually further reduced. Conversely, when the air-fuel mixture is changed from rich to lean, the value of the FAF is abruptly increased and then gradually further increased. In addition, if a rich air-fuel mixture continues to be fed into the engine cylinders, the FAF is reduced and reaches the lower guard value LFB, and then the FAF is maintained at the lower guard value LFB.

Figure 10:
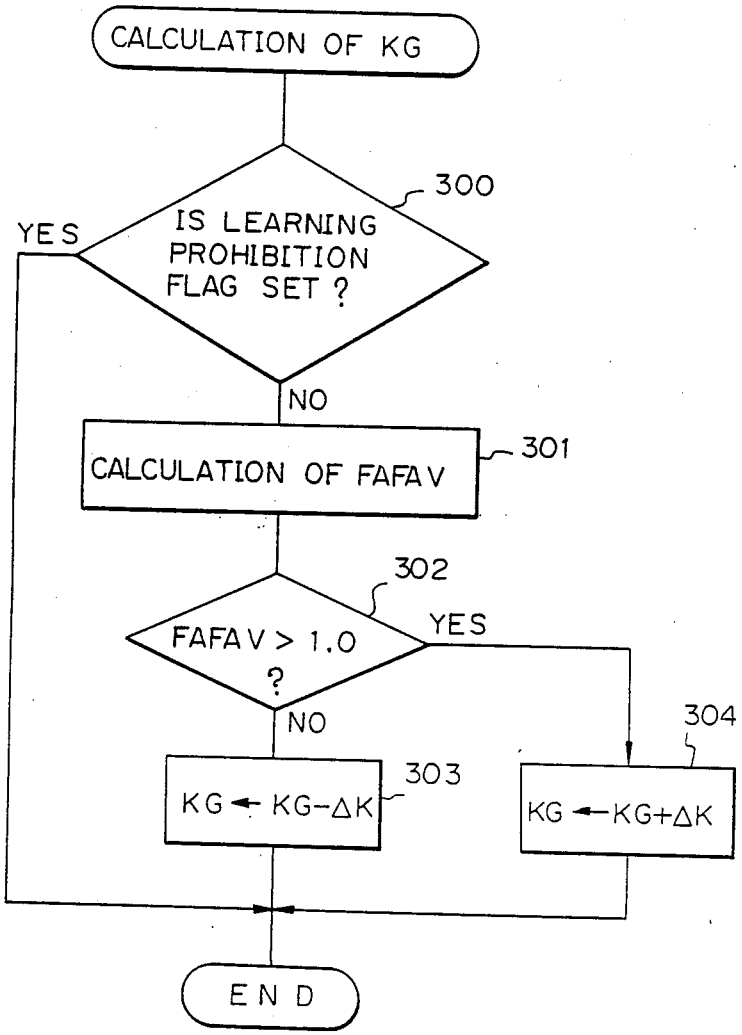
FIG. 10 is a flow chart for executing the calculation of the learning coefficient KG.

FIG. 10 illustrates a routine for the calculation of the learning value KG. The routine is processed when an FAF skipping operation is carried out several times.

Referring to FIG. 10, in step 300, it is determined whether or not a learning prohibition flag is set. This flag is set when it is considered that the engine is operating in a state where the normal feedback operation is not carried out. If the learning prohibition flag is reset, the routine goes to step 301, and the average FAFAV of the FAF is calculated. The FAFAV is the mean value of the latest two values of the FAF at the time immediately before the FAF skipping operation is carried out. Then, in step 302, it is determined whether or not FAFAV is larger than 1.0. If FAFAV≦1.0, the routine goes to step 303, and a fixed value ΔK is subtracted from the learning value KG. Conversely, if FAFAV>1.0, the routine goes to step 304, and the fixed value ΔK is added to the learning value KG.

Figure 11:
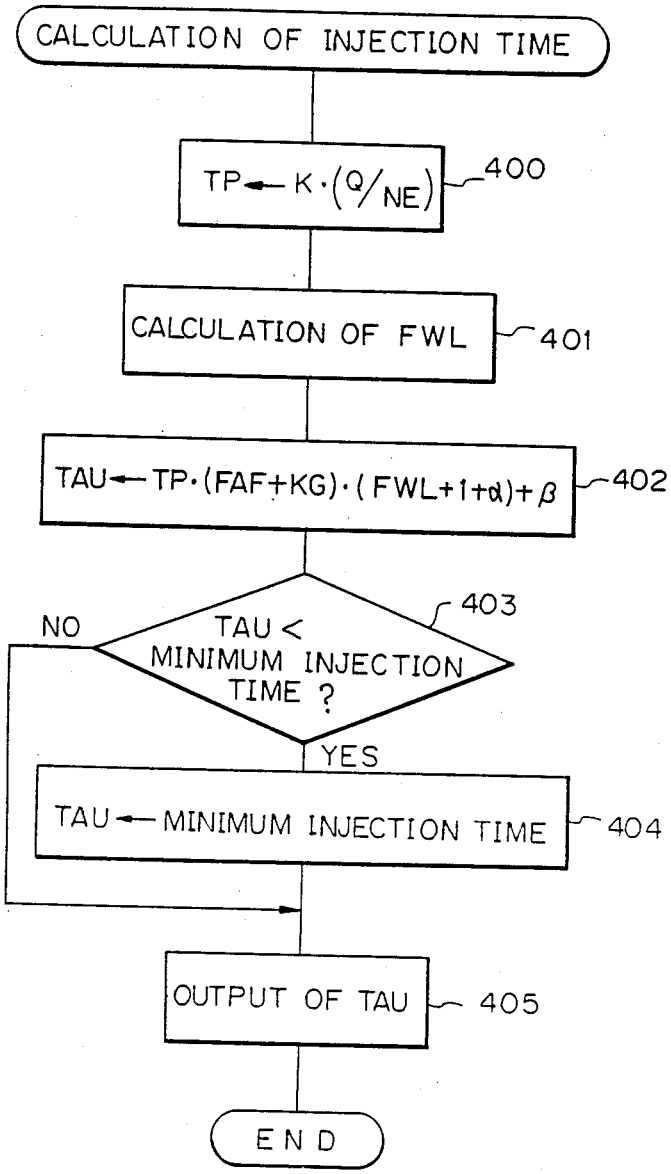
FIG. 11 is a flow chart for executing the calculation of the injection time TAU.

FIG. 11 illustrates a routine for the calculation of the injection time. This routine is processed at a predetermined crank angle.

Figure 12:
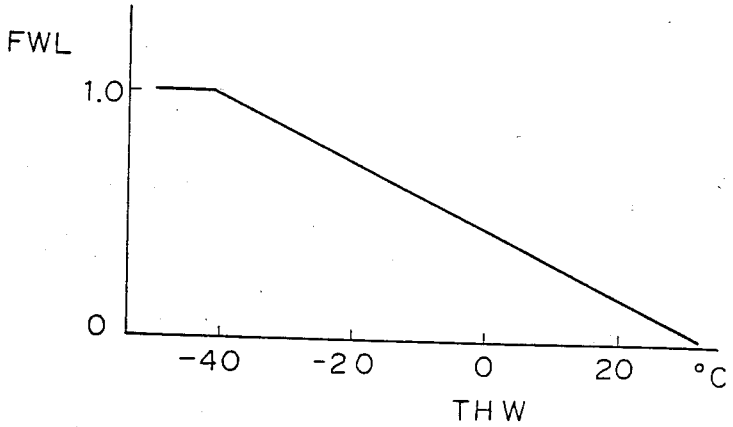
FIG. 12 is a diagram illustrating the relationship between the cooling water temperature THW and the temperature correction coefficient FWL.

Referring to FIG. 11, in step 400, the basic injection time TP is calculated from the engine speed NE and the amount of the air Q fed into the engine cylinders on the basis of the output signals of the engine speed sensor 20 and the air flow meter 103. In this step, K indicates a constant value. Then, in step 401, the temperature correction coefficient FW1 is calculated from the cooling water temperature THW on the basis of the cooling water temperature sensor 104. FIG. 12 illustrates the relationship between the temperature correction coefficient TWL and the cooling water temperature THW. This relationship is stored in the ROM 32. As mentioned above, when the feedback operation is carried out, FWL becomes zero.

Then, in step 402, the actual injection time TAU is calculated. Then, in step 403, it is determined whether or not the actual injection time TAU is smaller than a minimum injection time. If the actual injection time TAU is smaller than the minimum injection time, the routine goes to step 404, and the minimum injection time is memorized as the actual injection time TAU. Then, in step 405, the actual injection time TAU is output to the output port 36.

As mentioned above, when the supply of purge gas is started, the air-fuel mixture fed into the engine cylinders becomes rich. Particularly, when the engine is operating in an idling state after the engine has operated at a high speed, or when a motor vehicle is driven at a low speed for a long time due to, for example, heavy traffic, the temperature in the interior of the fuel tank 5 is considerably increased, and thus a large amount of fuel vapor is generated in the fuel tank 5. In this case, since a large amount of fuel vapor is fed into the intake passage 7 via the purge conduit 16 or via both the purge conduit 16 and the air conduit 111, the air-fuel mixture fed into the engine cylinders becomes excessively rich.

Figure 13:
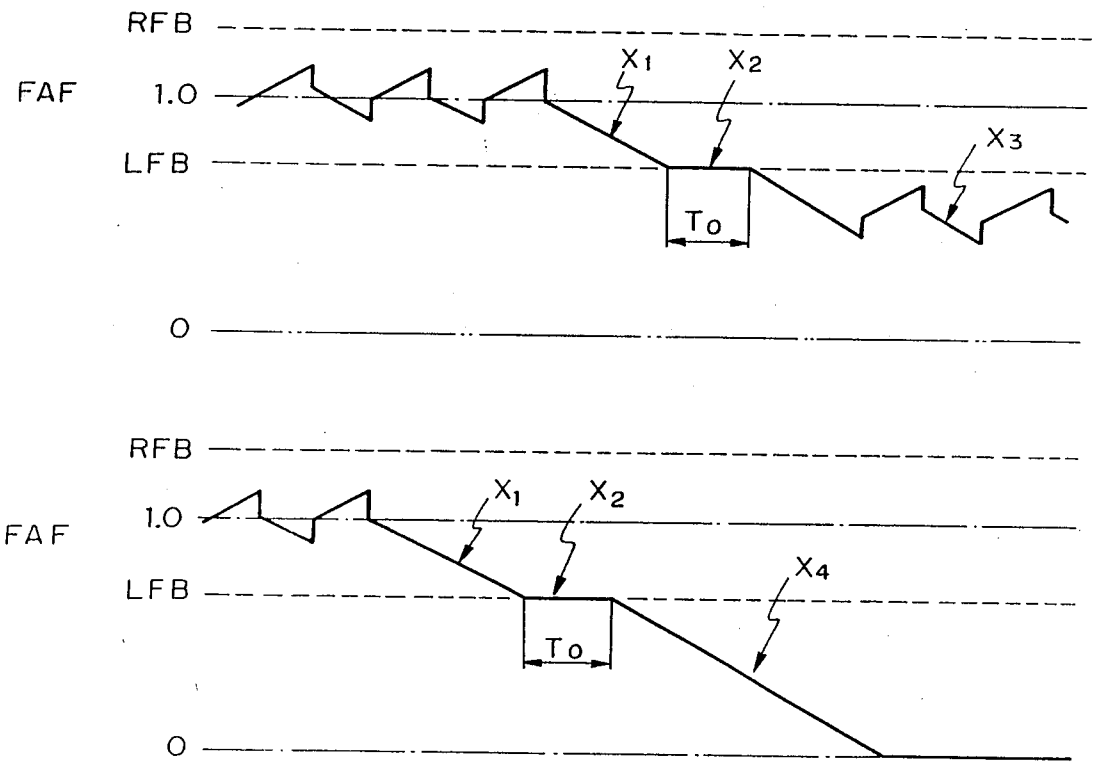
FIG. 13 is a time chart showing changes in the feedback correction coefficient FAF.

When the air-fuel mixture becomes excessively rich, the FAF is continuously reduced as illustrated by $X_1$ in FIG. 13, and then the FAF reaches the lower guard value LFB and is maintained at LFB as illustrated by $X_2$ in FIG. 13. If the FAF is maintained at LFB, a rich air-fuel mixture is still fed into the engine cylinders, and thus a large amount of unburned HC and CO is discharged from the engine cylinders. Consequently, in this embodiment, to prevent a rich air-fuel mixture from being continuously fed into the engine cylinders, when the length of time T during which the FAF is maintained at LFB exceeds a predetermined time $T_0$, the lower guard value LFB becomes zero, that is, the lower guard is taken off. If LFB is taken off, the FAF can be reduced to a level such that the air-fuel mixture becomes equal to the stoichiometric air-fuel ratio, and thus the feedback operation of air-fuel ratio is again started as illustrated by $X_3$ in FIG. 13 to equalize the air-fuel ratio with the stoichiometric air-fuel ratio.

When the air-fuel mixture fed into the engine cylinders becomes extremely rich due to the supply of purge gas, since the FAF is continuously reduced, the actual injection time TAU is also continuously reduced and, finally, TAU reaches the minimum injection time. At this time, if a rich air-fuel mixture is still fed into the engine cylinders, the FAF is further reduced and reaches zero as illustrated by $X_4$ in FIG. 13, and the feedback operation of the air-fuel ratio is stopped. At this time, although a rich air-fuel mixture is still fed into the engine cylinders, since the air-fuel mixture becomes leaner compared with the case where the lower guard is not taken off, it is possible to reduce the amount of unburned HC and CO discharged from the engine cylinders.

Figure 14:
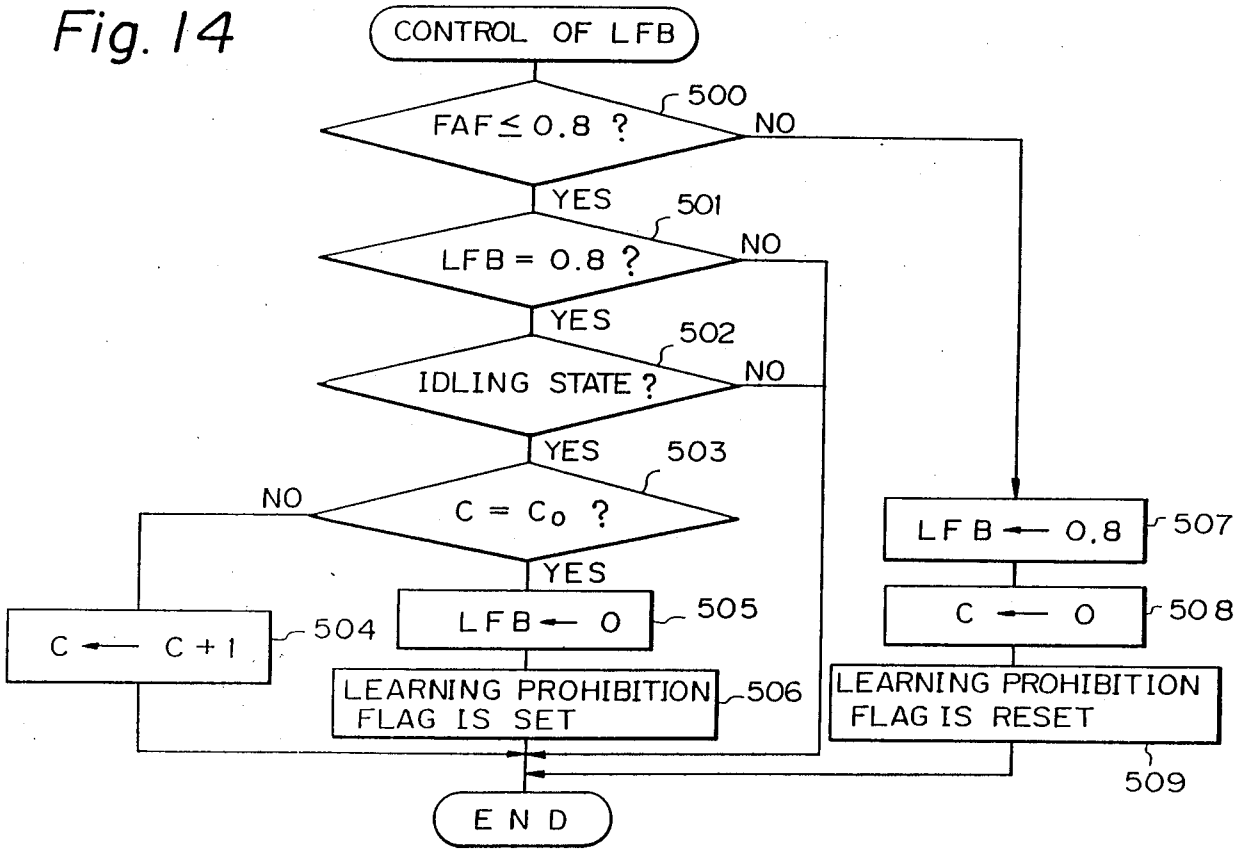
FIG. 14 is a flow chart for executing the control of the lower guard valve LFB.

FIG. 14 illustrates a routine for the control of the lower guard valve LFB, which is illustrated in FIG. 13. This routine is processed by sequential interruptions which are executed at predetermined intervals, for example, every 4 msec.

Referring to FIG. 14, in step 500, it is determined whether or not the FAF is equal to or smaller than, for example, 0.8. If FA<0.8, the routine goes to step 501, and it is determined whether or not LFB is equal to 0.8. If LFB=0.8, the routine goes to step 502, and it is determined whether or not the engine is operating in an idling state, on the basis of the output signal of the throttle switch 18. When the engine is operating in an idling state, the routine goes to step 503, and it is determined whether or not the count value C is equal to a fixed value $C_0$. If $C \neq C_0$, the routine goes to step 504, and the count value C is incremented by 1. Then, the processing cycle is completed. That is, when the FAF is maintained at 0.8, if the engine is operating in an idling state, the increment of the count value C is started.

Subsequently, when the count value C becomes equal to $C_0$, that is, when the predetermined time $T_0$ (FIG. 13) has elapsed, the routine goes to step 505, and the lower guard value LFB becomes equal to zero, that is, the lower guard is taken off. Then, in step 506, the learning prohibition flag is set. Consequently, at this time, the calculation of KG (FIG. 10) is interrupted. Then, the processing cycle is completed. In this embodiment illustrated in FIG. 14, when the engine is operating in an idling state, the lower guard is taken off only when the FAF is maintained at 0.8 for more than the time $T_0$. This is because, when the engine is operating in an idling state, the supply of fuel vapor from the charcoal canister 6 is a major influence on the air-fuel ratio because the amount of air fed into the engine cylinders is small. Consequently, if the air-fuel ratio control device is constructed so that the lower guard is taken off when the FAF is maintained at 0.8 for more than the time $T_0$ in an engine operating state other than an idling state, there is a danger that the lower guard will not be taken off even if the air-fuel mixture becomes excessively rich due to the supply of the purge gas in an idling state. In order to avoid such a danger, in the embodiment illustrated in FIG. 14, the lower guard is taken off when the FAF is maintained at 0.8 for more than the time $T_0$ in an idling state.

Once LFB becomes equal to zero, since the processing cycle is completed via steps 500 and 501, the FAF is reduced below 0.8 until the air-fuel ratio becomes equal to the stoichiometric air-fuel ratio.

Once a large amount of fuel component is fed from the charcoal canister 6 into the intake passage 7, the amount of this fuel component is gradually reduced. As a result, the FAF gradually becomes large. Then, when the FAF exceeds 0.8, the routine goes to step 507, and 0.8 is again memorized as the lower guard value LFB. Then, in step 508, the counter is cleared, and in step 509, the learning prohibition flag is reset. Consequently, at this time, the calculation of KG is started again.

Figure 15:
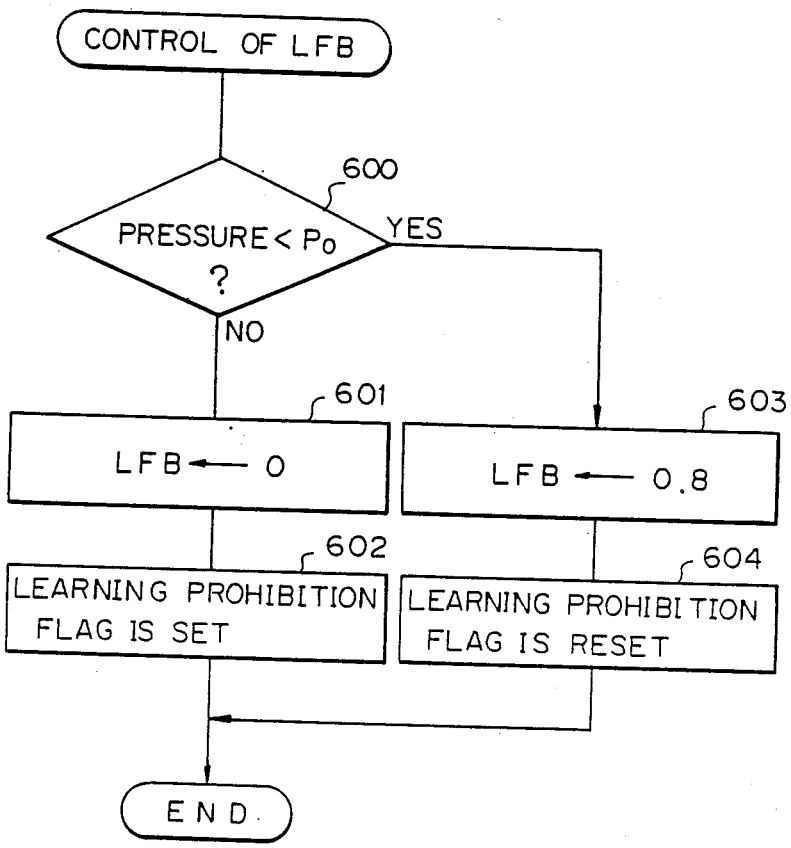
FIG. 15 is a flow chart of another embodiment for executing the control of the lower guard valve LFB.
Figure 16:
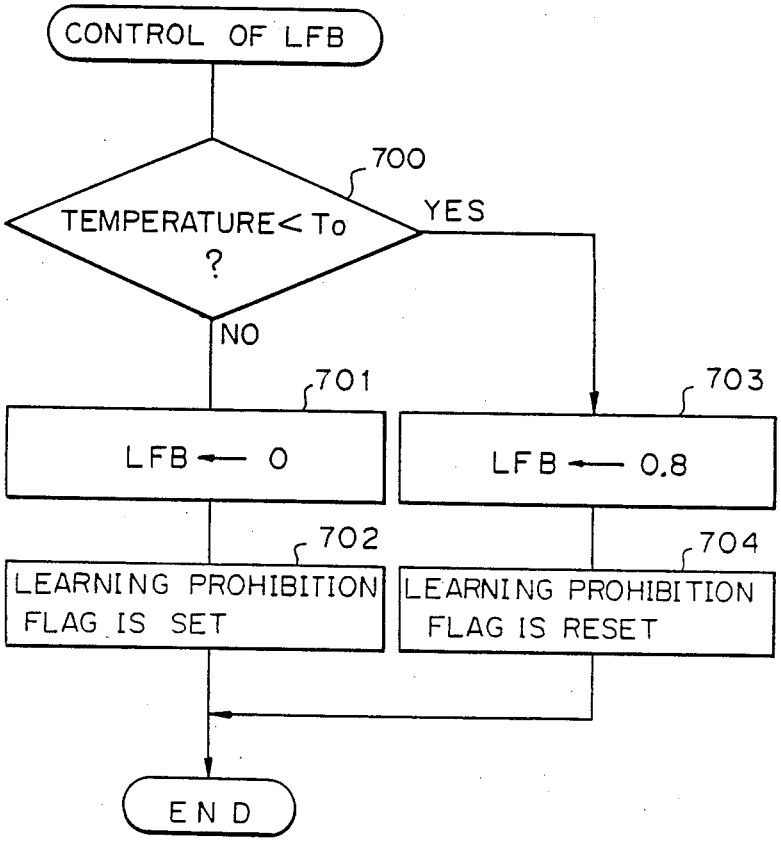
FIG. 16 is a flow chart of a further embodiment for executing the control of the lower guard valve LFB.
Figure 17:
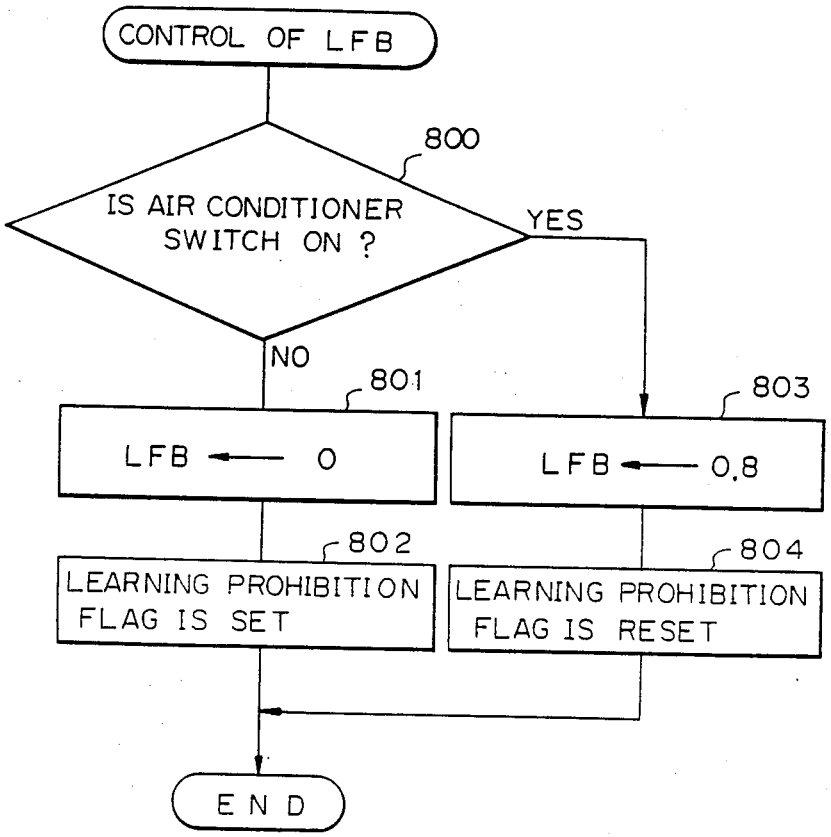
FIG. 17 is a flow chart of a still further embodiment for executing the control of the lower guard valve LFB.

In the embodiment illustrated in FIG. 14, whether or not an excessively rich air-fuel mixture is fed into the engine cylinders is determined by determining whether or not the FAF is lower than 0.8. However, whether or not an excessively rich air-fuel mixture is fed into the engine cylinders may be determined by determining whether or not a large amount of fuel vapor has been generated in the fuel tank 5. FIGS. 15 through 17 illustrate separate embodiments which control the lower guard value LFB on the basis of a determination of whether or not a large amount of fuel vapor has been generated in the fuel tank 5. The routines illustrated in FIGS. 15 through 17 are processed by sequential interruptions which are executed at predetermined intervals, for example, every 100 ms. If the pressure in the fuel tank 5 becomes high, a large amount of fuel vapor is generated in the fuel tank 5, and thus it is determined that the air-fuel mixture fed into the engine cylinders has become excessively rich. Consequently, in the embodiment illustrated in FIG. 15, the lower guard value LFB is controlled on the basis of the output signal of the pressure sensor 105 arranged in the fuel tank 5, so that the lower guard is taken off when the pressure in the fuel tank 5 exceeds a predetermined pressure.

Referring to FIG. 15, in step 600, it is determined whether or not the pressure in the fuel tank 5 is lower than a fixed pressure $P_0$, for example, 0.1 gauge kg/cm$^2$. If the pressure $\geqq P_0$, the routine goes to step 601, and the lower guard value LFB becomes equal to zero. Then, in step 602, the learning prohibition flag is set, and the processing cycle is completed.

Conversely, if the pressure $< P_0$, the routine goes to step 603, and 0.8 is memorized as the lower guard value LFB. Subsequently, in step 604, the learning prohibition flag is reset, and then the processing cycle is completed. In this embodiment, once the pressure becomes higher than $P_0$, the lower guard is instantaneously taken off.

If the temperature of fuel in the fuel tank 5 becomes high, a large amount of fuel vapor is generated in the fuel tank 5, and thus it is determined that the air-fuel mixture fed into the engine cylinders has become excessively rich. Consequently, in the embodiment illustrated in FIG. 16, the lower guard value LFB is controlled on the basis of the output signal of the temperature sensor 106 arranged in the fuel tank 5 so that the lower guard is taken off when the temperature of fuel in the fuel tank 5 exceeds a predetermined temperature.

Referring to FIG. 16, in step 700, it is determined whether or not the temperature of fuel in the fuel tank 5 is lower than a fixed temperature $T_0$, for example, 60° C. If the temperature $\geqq T_0$, the routine goes to step 701, and the lower guard value LFB becomes equal to zero. Then, in step 702, the learning prohibition flag is set, and the processing cycle is completed.

Conversely, if the temperature $< T_0$, the routine goes to step 703, and 0.8 is memorized as the lower guard value LFB. Then, in step 704, the learning prohibition flag is reset, and the processing cycle is completed. In this embodiment, once the temperature becomes higher than $T_0$, the lower guard is instantaneously taken off.

The air conditioner switch 107 is normally made ON when the engine is operating in a hot climate. Consequently, if the air conditioner switch 107 is ON, it is determined that a large amount of fuel vapor has been generated in the fuel tank 5, and that the air-fuel mixture fed into the engine cylinders has become excessively rich. Consequently, in the embodiment illustrated in FIG. 17, the lower guard value LFB is controlled on the basis of the output signal of the air conditioner switch 107 so that the lower guard is taken off when the air conditioner switch 107 is made ON.

Referring to FIG. 17, in step 800, it is determined whether or not the air conditioner switch 107 is ON. If the air conditioner switch 107 is ON, the routine goes to step 801, and the lower guard value LFB becomes equal to zero. Then, in step 602, the learning prohibition flag is set, and the processing cycle is completed.

Conversely, if the air conditioner switch 107 is OFF, the routine goes to step 803, and 0.8 is memorized as the lower guard value LFB. Then, in step 804, the learning prohibition flag is reset, and the processing cycle is completed. In this embodiment, once the air conditioner switch 107 is made ON, the lower guard is instantaneously taken off.

In this embodiment, when the air-fuel mixture fed into the engine cylinders becomes excessively rich due to the supply of purge gas, since the lower guard of the FAF is taken off, the FAF can be reduced to a value such that the air-fuel ratio becomes equal to the stoichiometric air-fuel ratio, and as a result, it is possible to reduce the amount of unburned HC and CO discharged from the engine cylinders.

Figure 18:
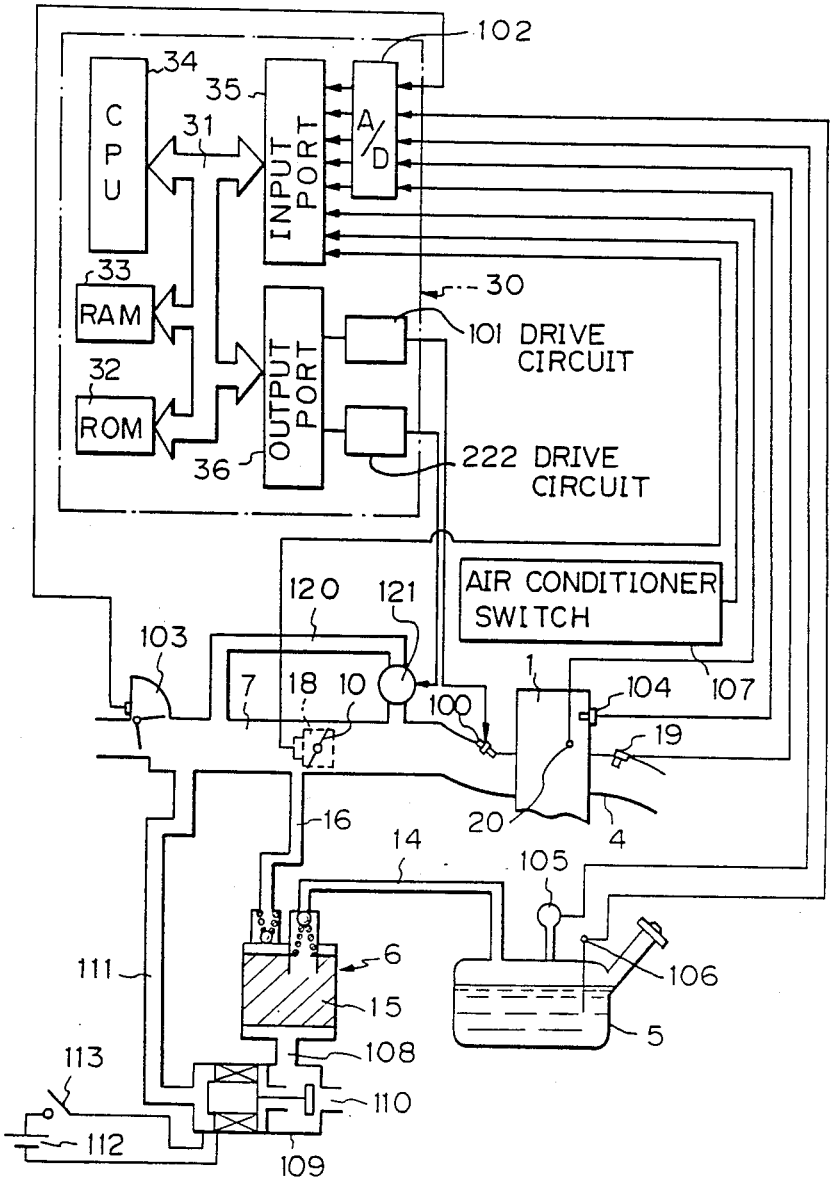
FIG. 18 is a schematically illustrated view of another embodiment of the fuel injection type engine.

FIG. 18 illustrates another embodiment of the fuel injection type engine. In FIG. 18, similar components are indicated with the same reference numerals used in FIG. 7.

Referring to FIG. 18, a bypass passage 120 is branched off from the intake passage 7 between the throttle valve 10 and the air flow meter 103 and connected to the intake passage 7 downstream of the throttle valve 10. A bypass valve 121 is arranged in the bypass passage 120 and connected to the input port 35 via a drive circuit 222. This bypass valve 121 is normally closed.

In the embodiment illustrated in FIG. 7, as described with reference to FIGS. 11 and 13, when the lower guard is taken off, and thus the FAF is reduced below 0.8, if the actual injection time TAU is reduced to the minimum injection time, the actual injection time TAU is maintained at the minimum injection time. At this time, the feedback operation of air-fuel ratio is stopped, and the air-fuel mixture is still in a rich state.

In the embodiment illustrated in FIG. 18, when the actual fuel injection time TAU is reduced and reaches the minimum injection time, the bypass valve 121 is opened, and air is fed from the bypass passage 120 into the intake passage 7 downstream of the throttle valve 10. As a result, the air-fuel mixture becomes leaner, and thus the feedback operation of air-fuel ratio is started again.

Figure 19:
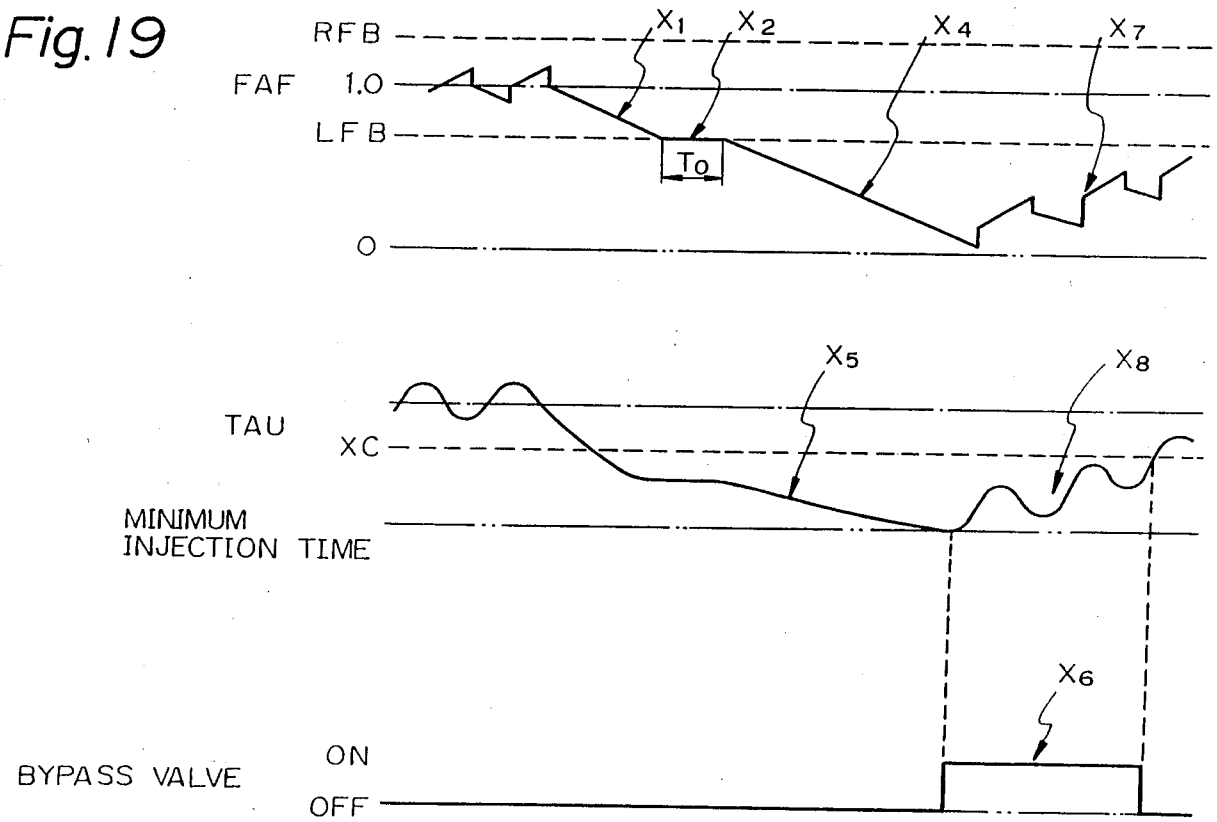
FIG. 19 is a time chart showing changes and in the feedback correction coefficient FAF and the injection time TAU, and showing the opening operation of the bypass valve.

That is, as illustrated in FIG. 19, in the embodiment illustrated in FIG. 18, if the FAF is maintained at the lower guard value LFB, for example, 0.8, for a fixed time $T_0$, the lower guard is taken off. As a result, the FAF is gradually reduced as illustrated by $X_4$ in FIG. 19, and thus the actual injection time TAU is also gradually reduced as illustrated by X in FIG. 19. Then, if the actual injection time TAU reaches the minimum injection time, the bypass valve 121 is opened as illustrated by $X_6$ in FIG. 19, and thus the supply of air from the bypass passage 120 is started. If the supply of air from the bypass passage 120 is started, the air-fuel mixture becomes leaner, and thus the feedback operation of the air-fuel ratio is carried out as illustrated by $X_7$ and $X_8$ in FIG. 19. As a result, the air-fuel ratio is controlled so that it becomes equal to the stoichiometric air-fuel ratio. Then, if the actual injection time TAU exceeds a fixed value XC (FIG. 19), the bypass valve 121 is closed, and thus the supply of air from the bypass passage 120 is stopped.

Figure 20A:
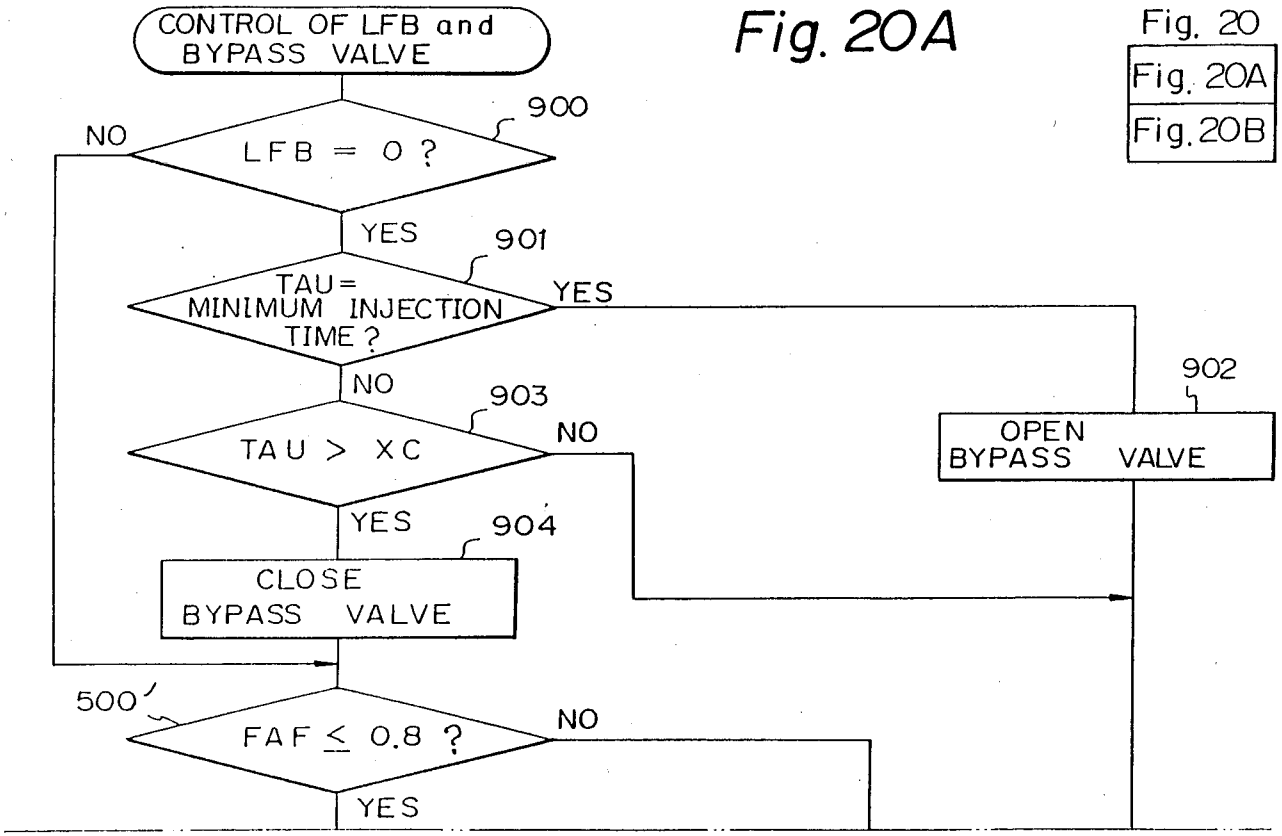
FIGS. 20A & 20B are a flow chart for executing the control of the lower guard valve LFB and the bypass valve.
Figure 20B:
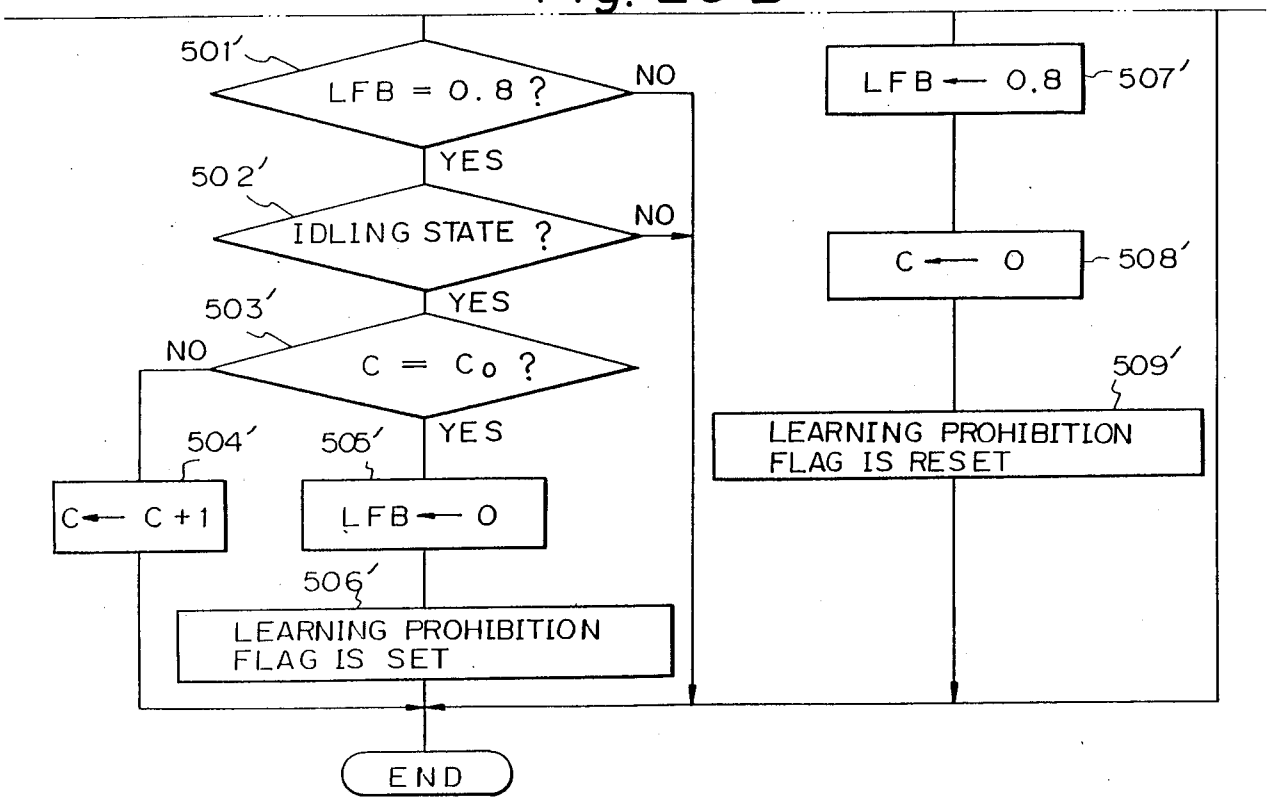

FIG. 20 illustrates a routine for the control of the lower guard value LFB and the bypass valve, which is illustrated in FIG. 19. This routine is processed by sequential interruptions which are executed at predetermined intervals, for example, every 4 msec.

Referring to FIG. 20, in step 900, it is determined whether or not the lower guard value LFB is equal to zero. When the lower guard value LFB is not equal to zero, the routine jumps to step 500'. Steps 500' through 509' are the same as steps 500 through 509 in FIG. 14, and therefore, a detailed description of each step 500' through 509' is omitted. In steps 500' through 506', if the FAF is maintained at 0.8 for a fixed time $T_0$ (FIG. 19), the lower guard value LFB becomes equal to zero, that is, the lower guard is taken off.

If the lower guard value LBF is equal to zero, the routine goes to step 901 from step 900, and it is determined whether or not the actual injection time TAU is equal to the minimum injection time. If TAU=minimum injection time, the routine goes to step 902, and the bypass valve 121 is opened, and as a result, the air-fuel mixture becomes leaner. Then, when TAU becomes larger than the minimum injection time, the routine goes to step 903 from step 901, and it is determined whether or not the actual injection time TAU is larger then XC (FIG. 19). This XC is equal to, for example, 0.8 the basic injection time TP. If TAU≦XC, the processing cycle is completed. Consequently, at this time, the bypass valve 121 remains open. If TAU becomes larger than XC, the routine goes to step 904 from step 903, and the bypass valve 121 is closed. Then, the routine goes to step 500'. After this, if the FAF becomes larger than 0.8, the routine goes to step 507' from step 500', and 0.8 is memorized as LFB. Consequently, in the next processing cycle, the routine jumps from step 900 to step 500'.

In the embodiment illustrated in FIG. 18, as mentioned above, the bypass valve 121 is merely closed or opened, and the control of the flow area of the bypass valve 121 is not carried out. However, the bypass valve 121 may be controlled on the basis of the output signal of the $O_2$ sensor 19 so that the flow area of the bypass valve 121 is gradually increased when the air-fuel mixture is rich, and that the flow area of the bypass valve 121 is gradually reduced when the air-fuel mixture is lean. Of course, this control of the flow area of the bypass valve 121 is carried out after the actual injection time TAU is reduced and reaches the minimum injection time.

In the embodiment illustrated in FIG. 20, as mentioned above, the same routine as that illustrated in FIG. 14 is used in steps 500' through 509'. However, instead of using the routine illustrated in FIG. 14, the routine illustrated in FIGS. 15, 16 or 17, may be used in steps 500' through 509'.

In this embodiment, when the actual injection time is reduced and reaches the minimum injection time due to the supply of purge gas, air is fed into the intake passage from the bypass passage so as to be able to carry out the feedback operation of air-fuel ratio. As a result, since the air-fuel ratio is controlled so that it becomes equal to the stoichiometric air-fuel ratio, it is possible to reduce the amount of unburned HC and CO discharged from the engine cylinders.

Figure 21:
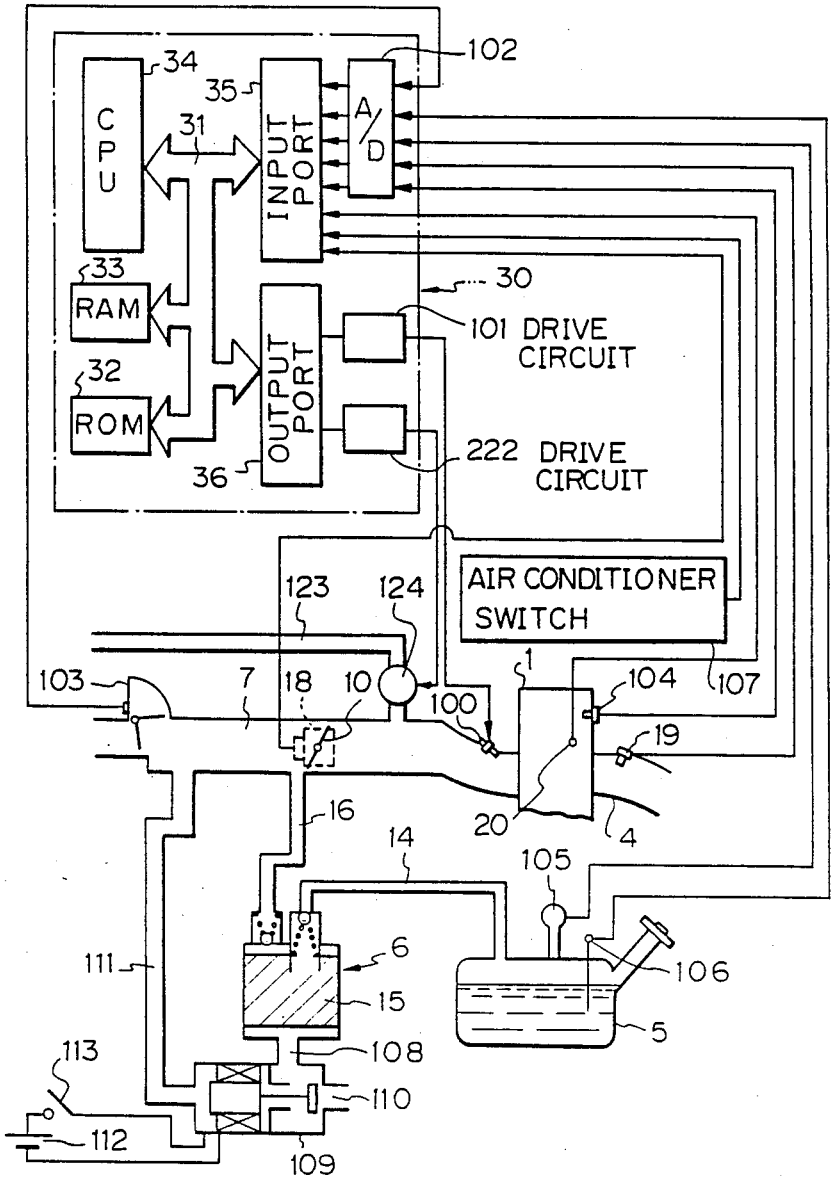
FIG. 21 is a schematically illustrated view of a further embodiment of the fuel injection type engine.

FIG. 21 illustrates a further embodiment of the fuel injection type engine. In FIG. 21, similar components are indicated with the same reference numerals used in FIG. 18.

In this embodiment, an air supply passage 123 having an inlet which is connected to the air cleaner (not shown) is connected to the intake passage 7 downstream of the throttle valve 10. An air control valve 124 is arranged in the air supply passage 123 and connected to the input port 35 via the drive circuit 222. This air control valve 124 is normally closed.

In the embodiment illustrated in FIG. 21, when the actual fuel injection time TAU is reduced and reaches the minimum injection time, the air control valve 124 is opened, and air is fed from the air supply passage 123 into the intake passage 7 downstream of the throttle valve 10. As a result, the air-fuel mixture becomes leaner, and thus the feedback operation of the air-fuel ratio is started again.

In this embodiment, air fed from the air supply passage 123 does not pass through the air-flow meter 103. Consequently, when the supply of air from the air supply passage 13 is started, the basic injection time TP is not changed, and thus there is no danger that the engine speed will be abruptly increased.

While the invention has been described by reference to specific embodiments chosen for purposes of illustration, it should be apparent that numerous modifications could be made thereto by those skilled in the art without departing from the basic concept and scope of the invention.

We claim:

1. An internal combustion engine having at least one cylinder, an intake passage and an exhaust passage, said engine comprising:

a charcoal canister containing activated carbon therein and connected to the intake passage via a purge passage;

fuel supply means arranged in the intake passage to feed fuel into the intake passage;

an oxygen concentration detector arranged in the exhaust passage to produce a lean signal when an air-fuel ratio of an air-fuel mixture fed into the cylinder is larger than a predetermined air-fuel ratio and to produce a rich signal when said air-fuel ratio of the air-fuel mixture is smaller than the predetermined air-fuel ratio;

first means producing an electric correction signal for correcting the amount of fuel fed from said fuel supply means in response to said lean signal and said rich signal to equalize said air-fuel ratio of said air-fuel mixture with the predetermined air-fuel ratio, said electric correction signal having a level which normally varies between a predetermined upper limit and a predetermined lower limit and reaches either one of said predetermined upper limit and said predetermined lower limit when the air-fuel mixture fed into the cylinder becomes excessively rich;

determining means for determining whether or not the level of said electric correction signal reaches either one of said predetermined upper limit and said predetermined lower limit; and second control means operated on the basis of a determination by said determining means to increase the air-fuel ratio of the air-fuel mixture fed into the cylinder until said air-fuel ratio becomes approximately equal to the predetermined air-fuel ratio when the level of said electric correction signal reaches either one of said predetermined upper limit and said predetermined lower limit.

2. An internal combustion engine according to claim 1, wherein said predetermined air-fuel ratio is the stoichiometric air-fuel ratio.

3. An internal combustion engine according to claim 1, wherein said purge passage has a purge control valve therein, and said fuel supply means comprises a carburetor arranged in the intake passage and having a fuel passage which is open to the intake passage, an air bleed passage connected to said fuel passage, and an electric control valve arranged in said air bleed passage to control the amount of air fed into said fuel passage from said air bleed passage in response to said electric correction signal, said amount of air increasing as the level of said electric correction signal rises, said first means controlling the level of said electric correction signal produced therefrom in response to said lean signal and said rich signal to raise the level of said electric correction signal when said rich signal is produced and lower the level of said electric correction signal when said lean signal is produced, said second control means instantaneously raises the level of said electric correction signal by a predetermined fixed level to increase said air-fuel ratio of the air-fuel mixture when the level of said electric correction signal reaches said upper limit and when said purge control valve is open.

4. An internal combustion engine according to claim 3, wherein said electric correction signal is represented by an electric current.

5. An internal combustion engine according to claim 3, wherein said purge control valve is closed when the engine is operating in an idling state.

6. An internal combustion engine according to claim 3, wherein said predetermined fixed level is determined so that said air-fuel ratio of the air-fuel mixture instantaneously becomes approximately equal to the predetermined air-fuel ratio.

7. An internal combustion engine according to claim 3, wherein said purge control valve is closed when the level of said electric correction signal reaches said upper limit to determine whether or not said air-fuel mixture has become excessively rich due to a supply of a purge gas.

8. An internal combustion engine according to claim 7, wherein said second control means instantaneously increases the level of said electric correction signal by said fixed level and again opens said purge control valve when the level of said electric correction signal is reduced below said upper limit after said purge control valve is closed.

9. An internal combustion engine according to claim 8, wherein said second control means again opens said purge control valve without instantaneously increasing the level of said electric correction signal by said fixed level when the level of said electric correction signal is not reduced below said upper limit after said purge control valve is closed.

10. An internal combustion engine according to claim 8, wherein said second control means instantaneously increases the level of said electric correction signal by said fixed level and again opens said purge control valve when the level of said electric correction signal is reduced below said upper limit within a fixed time after said purge control valve is closed.

11. An internal combustion engine according to claim 10, wherein said second control means again opens said purge control valve without instantaneously increasing the level of said electric correction signal by said fixed level when the level of said electric correction signal is not reduced below said upper limit within said fixed time after said purge control valve is closed.

12. An internal combustion engine according to claim 1, further comprising another determining means for determining whether or not said air-fuel mixture is excessively rich, wherein said fuel supply means comprises a fuel injector arranged in the intake passage to feed fuel into said intake passage, the amount of said fuel being corrected by the level of said electric correction signal, and increasing as the level of said electric correction signal rises, said first control means controlling the level of said electric correction signal produced therefrom in response to said lean signal and said rich signal to raise the level of said electric correction signal when said lean signal is produced and lower the level of said electric correction signal when said rich signal is produced, said second control means controlling said lower limit in response to a determination by said other determining means to normally maintain the level of said electric correction signal at said lower level when the level of said electric correction signal is reduced and reaches said lower level and to take off said lower limit and allowing the level of said electric correction signal to fall below said lower limit when said air-fuel mixture is excessively rich.

13. An internal combustion engine according to claim 12, wherein said other determining means determines that said air-fuel mixture is excessively rich when the level of said electric correction signal is maintained at said lower limit for a fixed time.

14. An internal combustion engine according to claim 13, wherein said other determining means determines that said air-fuel mixture is excessively rich when the level of said electric correction signal is maintained at said lower limit for a fixed time and when the engine is operating in an idling state.

15. An internal combustion engine according to claim 12, further comprising a pressure sensor arranged in a fuel tank, wherein said other determining means determines that said air-fuel mixture is excessively rich when pressure in an interior of said fuel tank exceeds a predetermined pressure.

16. An internal combustion engine according to claim 12, further comprising a temperature sensor arranged in a fuel tank, wherein said other determining means determines that said air-fuel mixture is excessively rich when a temperature of fuel in said fuel tank exceeds a predetermined temperature.

17. An internal combustion engine according to claim 12, further comprising an air condition switch, wherein said other determining means determines that said air-fuel mixture is excessively rich when said air conditioner switch is ON.

18. An internal combustion engine according to claim 12, further comprising third control means for learning a preceding change in the level of said electric correction signal to control the amount of the fuel fed from said fuel injector so that the level of said electric correction signal varies around a predetermined level, said third control means stopping control of said amount of fuel when said lower limit is taken off.

19. An internal combustion engine according to claim 12, further comprising a throttle valve arranged in the intake passage, a bypass passage branched off from the intake passage upstream of said throttle valve and connected to the intake passage downstream of said throttle valve, a bypass valve arranged in said bypass passage, and fourth control means controlling said bypass valve in response to the amount of the fuel fed from said fuel injector to open said bypass valve when said amount of the fuel becomes equal to a predetermined minimum amount and when said lower limit is taken off.

20. An internal combustion engine according to claim 19, where said fourth control means closes said bypass valve when said amount of the fuel exceeds a predetermined amount which is larger than said minimum amount.

21. An internal combustion engine according to claim 12, wherein the intake passage has therein a throttle valve and an air flow meter arranged upstream of said throttle valve, and said charcoal canister has an air inlet and a control valve connecting said air inlet to the outside air when the engine is stopped and connecting said air inlet to the intake passage between said throttle valve and said air flow meter when the engine is operating.

22. An internal combustion engine according to claim 12, further comprising a throttle valve arranged in the intake passage, an air supply passage connected to the intake passage downstream of said throttle valve, an air control valve arranged in said air supply passage, and fourth control means controlling said air control valve in response to the amount of the fuel fed from said fuel injector to open said air control valve when said amount of the fuel becomes equal to a predetermined minimum amount and when said lower limit is taken off.

23. An internal combustion engine according to claim 22, where said fourth control means closes said air control valve when said amount of the fuel exceeds a predetermined amount which is larger than said minimum amount.

* * * * *